US008874450B2

(12) United States Patent
Peng et al.

(10) Patent No.: US 8,874,450 B2
(45) Date of Patent: Oct. 28, 2014

(54) HIERARCHICAL AUDIO FREQUENCY ENCODING AND DECODING METHOD AND SYSTEM, HIERARCHICAL FREQUENCY ENCODING AND DECODING METHOD FOR TRANSIENT SIGNAL

(75) Inventors: Ke Peng, Shenzhen (CN); Guoming Chen, Shenzhen (CN); Hao Yuan, Shenzhen (CN); Dongping Jiang, Shenzhen (CN); Jiali Li, Shenzhen (CN)

(73) Assignee: ZTE Corporation, Shenzhen, Guangdong Province (CN)

( * ) Notice: Subject to any disclaimer, the term of this patent is extended or adjusted under 35 U.S.C. 154(b) by 277 days.

(21) Appl. No.: 13/580,855

(22) PCT Filed: Jan. 12, 2011

(86) PCT No.: PCT/CN2011/070206

§ 371 (c)(1),
(2), (4) Date: Aug. 23, 2012

(87) PCT Pub. No.: WO2011/127757

PCT Pub. Date: Oct. 20, 2011

(65) Prior Publication Data

US 2012/0323582 A1 Dec. 20, 2012

(30) Foreign Application Priority Data

Apr. 13, 2010 (CN) ..... 2010 1 0145531

(51) Int. Cl.
*G10L 19/00* (2013.01)
*G10L 19/24* (2013.01)
*G10L 19/025* (2013.01)

(52) U.S. Cl.
CPC ..... *G10L 19/24* (2013.01); *G10L 19/025* (2013.01)
USPC ..... 704/501; 704/205

(58) Field of Classification Search
CPC ..... G10L 19/24; G10L 19/025
See application file for complete search history.

(56) References Cited

U.S. PATENT DOCUMENTS 5,388,181 A * 2/1995 Anderson et al. ..... 704/200.1
5,394,473 A * 2/1995 Davidson ..... 704/200.1

(Continued)

FOREIGN PATENT DOCUMENTS

CN 1849649 A 10/2006
CN 101206860 A 6/2008

(Continued)

OTHER PUBLICATIONS

ITU-T Recommendation G.718, "Frame error robust narrow-band and wideband embedded variable bit-rate coding of speech and audio from 8-32 kbit/s", Jun. 2008.*

(Continued)

*Primary Examiner* — Brian Albertalli
(74) *Attorney, Agent, or Firm* — McClure, Qualey & Rodack, LLP

(57) ABSTRACT

Hierarchical audio coding and decoding method and system and hierarchical audio coding and decoding method for transient signals are provided. In the present invention, by introducing a processing method for transient signal frames in the hierarchical audio coding and decoding methods, a segmented time-frequency transform is performed on the transient signal frames, and then the frequency-domain coefficients obtained by transformation are rearranged respectively within the core layer and within the extended layer, so as to perform the same subsequent coding processes, such as bit allocation, frequency-domain coefficient coding, etc., as those on the steady-state signal frames, thus enhancing the coding efficiency of the transient signal frames and improving the quality of the hierarchical audio coding and decoding.

20 Claims, 8 Drawing Sheets

(56) References Cited

U.S. PATENT DOCUMENTS

| | | | | |
|---|---|---|---|---|
| 5,502,789 | A * | 3/1996 | Akagiri | 704/204 |
| 5,886,276 | A * | 3/1999 | Levine et al. | 84/603 |
| 6,418,408 | B1 | 7/2002 | Udaya Bhaskar et al. | |
| 6,487,535 | B1 * | 11/2002 | Smyth et al. | 704/500 |
| 6,658,382 | B1 * | 12/2003 | Iwakami et al. | 704/224 |
| 7,003,454 | B2 * | 2/2006 | Ramo | 704/223 |
| 7,313,519 | B2 * | 12/2007 | Crockett | 704/226 |
| 7,328,150 | B2 * | 2/2008 | Chen et al. | 704/219 |
| 7,386,445 | B2 * | 6/2008 | Ojala | 704/219 |
| 7,895,034 | B2 * | 2/2011 | You | 704/200.1 |
| 7,917,370 | B2 * | 3/2011 | Tsai et al. | 704/500 |
| 8,103,516 | B2 * | 1/2012 | Oshikiri | 704/501 |
| 8,290,782 | B2 * | 10/2012 | Shmunk | 704/500 |
| 8,417,532 | B2 * | 4/2013 | Schnell et al. | 704/501 |
| 8,706,511 | B2 * | 4/2014 | Taleb | 704/503 |

FOREIGN PATENT DOCUMENTS

| | | | |
|---|---|---|---|
| CN | 101414864 | A | 4/2009 |
| CN | 101622667 | A | 1/2010 |

OTHER PUBLICATIONS

3GPP TS 26.290, "Extended Adaptive Multi-Rate—Wideband (AMR-WB+) codec", Jan. 2010.*

International Search Report for PCT/CN2011/070206.

Tammi, et al.: "Scalable Superwideband Extension for Wideband Coding", Nokia Research Center, Tampere, Finland, Copyright 2009 IEEE, pp. 161-164.

Geiser, et al.: "A Qualified ITU-T G.729EV Codec Candidate for Hierarchical Speech and Audio Coding"; Copyright 2006 IEEE; pp. 114-118.

* cited by examiner

| | | | | | | |
|---|---|---|---|---|---|---|
| Frame head | Side information bits of the core layer | Amplitude envelope coded bits of the core layer coding sub-bands | Coded bits of the core layer frequency-domain coefficients | Side information bits of the extended layer | Amplitude envelope coded bits of the extended layer coding sub-bands | Coded bits of the extended layer coding signals |

HIERARCHICAL AUDIO FREQUENCY ENCODING AND DECODING METHOD AND SYSTEM, HIERARCHICAL FREQUENCY ENCODING AND DECODING METHOD FOR TRANSIENT SIGNAL

CROSS-REFERENCE TO RELATED APPLICATION

This application is a co-pending application which claims priority to PCT Application No. PCT/CN2011/070206, filed Jan. 12, 2011, entitled "Hierarchical Audio Frequency Encoding and Decoding Method and System, Hierarchical Frequency Encoding and Decoding Method for Transient Signal" herein incorporated by reference in its entirety. This application also claims priority to, and the benefit of, Chinese patent application 201010145531.1, filed Apr. 13, 2010, herein incorporated by reference in its entirety.

TECHNICAL FIELD

The present invention relates to an audio coding and decoding technology, and in particular, to a hierarchical audio coding and decoding method and system, and a hierarchical coding and decoding method for transient signals.

BACKGROUND OF THE RELATED ART

Hierarchical audio coding is dedicated to organizing bit streams resulting from audio coding in a hierarchical way, which are generally divided into one core layer and several extended layers. A decoder is able to implement to only decode the coded bit stream of a low layer (such as the core layer) in a situation of no coded bit stream of a high layer (such as a extended layer) available, and the more layers are decoded, the more the audio quality is improved.

The hierarchical coding technology has a very important practical value for a communication network. On one hand, data transfer can be completed by the cooperation of different channels, and packet loss rate of each channel may be different; and at this point, it often requires to perform a hierarchical process on the data, put important parts of the data into steady channels with relatively low packet loss rates for transmission, and put secondary parts of the data into non-steady channels with relatively high packet loss rates for transmission, so as to ensure that only a relative reduction of the audio quality occurs when the packet loss occurs in the non-steady channels, without a condition that one frame of data cannot be decoded completely. On the other hand, the bandwidth of some communications networks (such as Internet) is very unstable, and the bandwidths of different user terminals are various. It is impossible to use one fixed bit rate to meet the requirements from the users with different bandwidths, while the use of hierarchal coding scheme enables different users to obtain the respective optimum enjoyment regarding tone quality under their own bandwidth conditions.

Traditional hierarchical audio coding schemes, such as G.729.1 and G.VBR of the International Telecommunication Union (ITU), do not perform a targeted process for transient signal frames, and therefore, for signals comprising major transient components (such as a percussion signal), the coding efficiency is low, especially with moderate and low bit rates.

SUMMARY OF THE INVENTION

The technical problem to be solved by the present invention is to provide an efficient hierarchical audio coding and decoding method and system, and a hierarchical coding and decoding method for transient signals, so as to improve the quality of the hierarchical audio coding and decoding.

In order to solve the above problem, the present invention provides a hierarchical audio coding method, comprising:

performing a transient detection on an audio signal of a current frame;

when the transient detection is to be a steady-state signal, performing a time-frequency transform on an audio signal to obtain total frequency-domain coefficients; when the transient detection is to be a transient signal, dividing the audio signal into M sub-frames, performing the time-frequency transform on each sub-frame, the M groups of frequency-domain coefficients obtained by transformation constituting total frequency-domain coefficients of the current frame, rearranging the total frequency-domain coefficients so that their corresponding coding sub-bands are aligned from low frequencies to high frequencies, wherein, the total frequency-domain coefficients comprise core layer frequency-domain coefficients and extended layer frequency-domain coefficients, the coding sub-bands comprise core layer coding sub-bands and extended layer coding sub-bands, the core layer frequency-domain coefficients constitute several core layer coding sub-bands, and the extended layer frequency-domain coefficients constitute several extended layer coding sub-bands;

quantizing and coding amplitude envelope values of the core layer coding sub-bands and the extended layer coding sub-bands, to obtain amplitude envelope quantization indexes and amplitude envelope coded bits of the core layer coding sub-bands and the extended layer coding sub-bands; wherein, if the signal is the steady-state signal, the amplitude envelope values of the core layer coding sub-bands and the extended layer coding sub-bands are jointly quantized, and if the signal is the transient signal, the amplitude envelope values of the core layer coding sub-bands and the extended layer coding sub-bands are separately quantized respectively, and the amplitude envelope quantization indexes of the core layer coding sub-bands and the amplitude envelope quantization indexes of the extended layer coding sub-bands are rearranged respectively;

performing a bit allocation on the core layer coding sub-bands according to the amplitude envelope quantization indexes of the core layer coding sub-bands, and then quantizing and coding the core layer frequency-domain coefficients to obtain coded bits of the core layer frequency-domain coefficients;

inversely quantizing the above-described frequency-domain coefficients in the core layer which are performed with a vector quantization, and performing a difference calculation with original frequency-domain coefficients, which are obtained after being performed with the time-frequency transform, to obtain core layer residual signals;

calculating the amplitude envelope quantization indexes of the core layer residual signals according to bit allocation numbers and the amplitude envelope quantization indexes of the core layer coding sub-bands;

performing the bit allocation on coding sub-bands of extended layer coding signals according to the amplitude envelope quantization indexes of the core layer residual signals and the amplitude envelope quantization indexes of the extended layer coding sub-bands, and then quantizing and coding the extended layer coding signals to obtain coded bits of the extended layer coding signals, wherein, the extended layer coding signals are comprised of the core layer residual signals and the extended layer frequency-domain coefficients; and multiplexing and packeting the amplitude envelope coded bits of the core layer coding sub-bands and the extended layer coding sub-bands, the coded bits of the core layer frequency-domain coefficients and the coded bits of the extended layer coding signals, and then transmitting to a decoding end.

In order to solve the above problem, the present invention further provides a hierarchical audio decoding method, comprising:

demultiplexing a bit stream transmitted by a coding end, decoding amplitude envelope coded bits of core layer coding sub-bands and extended layer coding sub-bands, to obtain amplitude envelope quantization indexes of the core layer coding sub-bands and the extended layer coding sub-bands; if transient detection information indicates a transient signal, further rearranging the amplitude envelope quantization indexes of the core layer coding sub-bands and the extended layer coding sub-bands respectively so that their corresponding frequencies are aligned from low to high within the respective layers;

performing a bit allocation on the core layer coding sub-bands according to the amplitude envelope quantization indexes of the core layer coding sub-bands, thus calculating amplitude envelope quantization indexes of core layer residual signals, and performing the bit allocation on the coding sub-bands of the extended layer coding signals according to the amplitude envelope quantization indexes of the core layer residual signals and the amplitude envelope quantization indexes of the extended layer coding sub-bands;

decoding coded bits of core layer frequency-domain coefficients and coded bits of the extended layer coding signals respectively according to bit allocation numbers of the core layer coding sub-bands and the coding sub-bands of the extended layer coding signals, to obtain the core layer frequency-domain coefficients and the extended layer coding signals, and rearranging the extended layer coding signals in an order of the sub-bands and adding them with the core layer frequency-domain coefficients, to obtain frequency-domain coefficients of total bandwidth; and if the transient detection information indicates a steady-state signal, directly performing an inverse time-frequency transform on the frequency-domain coefficients of the total bandwidth, to obtain an audio signal for output; and if the transient detection information indicates a transient signal, rearranging the frequency-domain coefficients of the total bandwidth, then dividing them into M groups of frequency-domain coefficients, performing the inverse time-frequency transform on each group of frequency-domain coefficients, and calculating to obtain a final audio signal according to M groups of time-domain signals obtained by transformation.

In order to solve the above problem, the present invention further provides a hierarchical audio coding method for transient signals, comprising:

dividing an audio signal into M sub-frames, performing a time-frequency transform on each sub-frame, the M groups of frequency-domain coefficients obtained by transformation constituting total frequency-domain coefficients of a current frame, rearranging the total frequency-domain coefficients so that their corresponding coding sub-bands are aligned from low frequencies to high frequencies, wherein, the total frequency-domain coefficients comprise core layer frequency-domain coefficients and extended layer frequency-domain coefficients, the coding sub-bands comprise core layer coding sub-bands and extended layer coding sub-bands, the core layer frequency-domain coefficients constitute several core layer coding sub-bands, and the extended layer frequency-domain coefficients constitute several extended layer coding sub-bands;

quantizing and coding amplitude envelope values of the core layer coding sub-bands and the extended layer coding sub-bands, to obtain amplitude envelope quantization indexes and coded bits of the core layer coding sub-bands and the extended layer coding sub-bands; wherein, the amplitude envelope values of the core layer coding sub-bands and the extended layer coding sub-bands are separately quantized respectively, and the amplitude envelope quantization indexes of the core layer coding sub-bands and the amplitude envelope quantization indexes of the extended layer coding sub-bands are rearranged respectively;

performing a bit allocation on the core layer coding sub-bands according to the amplitude envelope quantization indexes of the core layer coding sub-bands, and then quantizing and coding the core layer frequency-domain coefficients to obtain coded bits of the core layer frequency-domain coefficients;

inversely quantizing the above-described frequency-domain coefficients in the core layer which are performed with a vector quantization, and perform a difference calculation with original frequency-domain coefficients, which are obtained after being performed with the time-frequency transform, to obtain core layer residual signals;

calculating amplitude envelope quantization indexes of coding sub-bands of the core layer residual signals according to the amplitude envelope quantization indexes of the core layer coding sub-bands and bit allocation numbers of the core layer coding sub-bands;

performing a bit allocation on coding sub-bands of extended layer coding signals according to the amplitude envelope quantization indexes of the core layer residual signals and the amplitude envelope quantization indexes of the extended layer coding sub-bands, and then quantizing and coding the extended layer coding signals to obtain coded bits of the extended layer coding signals, wherein, the extended layer coding signals are comprised of the core layer residual signals and the extended layer frequency-domain coefficients; and multiplexing and packeting the amplitude envelope coded bits of the core layer coding sub-bands and the extended layer coding sub-bands, the coded bits of the core layer frequency-domain coefficients and the coded bits of the extended layer coding signals, and then transmitting to a decoding end.

In order to solve the above problem, the present invention further provides a hierarchical decoding method for transient signals, comprising:

demultiplexing a bit stream transmitted by a coding end, decoding amplitude envelope coded bits of core layer coding sub-bands and extended layer coding sub-bands, to obtain amplitude envelope quantization indexes of the core layer coding sub-bands and the extended layer coding sub-bands, rearranging the amplitude envelope quantization indexes of the core layer coding sub-bands and the extended layer coding sub-bands respectively so that their corresponding frequencies are aligned from low to high within the respective layers;

performing a bit allocation on the core layer coding sub-bands according to the rearranged amplitude envelope quantization indexes of the core layer coding sub-bands, and thus calculating amplitude envelope quantization indexes of core layer residual signals;

performing the bit allocation on the extended layer coding sub-bands according to the amplitude envelope quantization indexes of the core layer residual signals and the rearranged amplitude envelope quantization indexes of the extended layer coding sub-bands;

decoding coded bits of core layer frequency-domain coefficients and coded bits of extended layer coding signals respectively according to bit allocation numbers of the core layer coding sub-bands and coding sub-bands of the extended layer coding signals, to obtain the core layer frequency-domain coefficients and the extended layer coding signals, and rearranging the extended layer coding signals in an order of the sub-bands and adding them with the core layer frequency-domain coefficients, to obtain frequency-domain coefficients of total bandwidth; and rearranging the frequency-domain coefficients of the total bandwidth, and then dividing into M groups, performing an inverse time-frequency transform on each group of frequency-domain coefficients, and calculating to obtain a final audio signal according to M groups of time-domain signals obtained by transformation.

In order to solve the above problem, the present invention further provides a hierarchical audio coding system, comprising:

a frequency-domain coefficient generation unit, an amplitude envelope calculation unit, an amplitude envelope quantization and coding unit, a core layer bit allocation unit, a core layer frequency-domain coefficient vector quantization and coding unit, and a bit stream multiplexer; and further comprising: a transient detection unit, an extended layer coding signal generation unit, a residual signal amplitude envelope generation unit, an extended layer bit allocation unit, and an extended layer coding signal vector quantization and coding unit; wherein, the transient detection unit is configured to perform a transient detection on an audio signal of a current frame;

the frequency-domain coefficient generation unit is connected with the transient detection unit, and is configured to: when the transient detection is to be a steady-state signal, perform a time-frequency transform on an audio signal to obtain total frequency-domain coefficients; when the transient detection is to be a transient signal, divide the audio signal into M sub-frames, perform the time-frequency transform on each sub-frame, constitute total frequency-domain coefficients of the current frame by the M groups of frequency-domain coefficients obtained by transformation, rearrange the total frequency-domain coefficients so that their corresponding coding sub-bands are aligned from low frequencies to high frequencies, wherein, the total frequency-domain coefficients comprise core layer frequency-domain coefficients and extended layer frequency-domain coefficients, the coding sub-bands comprise core layer coding sub-bands and extended layer coding sub-bands, the core layer frequency-domain coefficients constitute several core layer coding sub-bands, and the extended layer frequency-domain coefficients constitute several extended layer coding sub-bands;

the amplitude envelope calculation unit is connected with the frequency-domain coefficient generation unit, and is configured to calculate amplitude envelope values of the core layer coding sub-bands and the extended layer coding sub-bands;

the amplitude envelope quantization and coding unit is connected with the amplitude envelope calculation unit and the transient detection unit, and is configured to quantize and code the amplitude envelope values of the core layer coding sub-bands and the extended layer coding sub-bands, to obtain amplitude envelope quantization indexes and amplitude envelope coded bits of the core layer coding sub-bands and the extended layer coding sub-bands; wherein, if the signal is the steady-state signal, the amplitude envelope values of the core layer coding sub-bands and the extended layer coding sub-bands are jointly quantized, and if the signal is the transient signal, the amplitude envelope values of the core layer coding sub-bands and the extended layer coding sub-bands are separately quantized respectively, and the amplitude envelope quantization indexes of the core layer coding sub-bands and the amplitude envelope quantization indexes of the extended layer coding sub-bands are rearranged respectively;

the core layer bit allocation unit is connected with the amplitude envelope quantization and coding unit, and is configured to perform a bit allocation on the core layer coding sub-bands according to the amplitude envelope quantization indexes of the core layer coding sub-bands, to obtain bit allocation numbers of the core layer coding sub-bands;

the core layer frequency-domain coefficient vector quantization and coding unit is connected with the frequency-domain coefficient generation unit, the amplitude envelope quantization and coding unit and the core layer bit allocation unit, and is configured to: perform normalization, vector quantization and coding on the frequency-domain coefficients of the core layer coding sub-bands by using the bit allocation numbers of the core layer coding sub-bands and a quantized amplitude envelope values of the core layer coding sub-bands reconstructed according to the amplitude envelope quantization indexes of the core layer coding sub-bands, to obtain coded bits of the core layer frequency-domain coefficients;

the extended layer coding signal generation unit is connected with the frequency-domain coefficient generation unit and the core layer frequency-domain coefficient vector quantization and coding unit, and is configured to generate core layer residual signals, to obtain extended layer coding signals comprised of the core layer residual signals and the extended layer frequency-domain coefficients;

the residual signal amplitude envelope generation unit is connected with the amplitude envelope quantization and coding unit and the core layer bit allocation unit, and is configured to obtain amplitude envelope quantization indexes of the core layer residual signals according to the amplitude envelope quantization indexes of the core layer coding sub-bands and the bit allocation numbers of the corresponding core layer coding sub-bands;

the extended layer bit allocation unit is connected with the residual signal amplitude envelope generation unit and the amplitude envelope quantization and coding unit, and is configured to perform the bit allocation on the coding sub-bands of the extended layer coding signals according to the amplitude envelope quantization indexes of the core layer residual signals and the amplitude envelope quantization indexes of the extended layer coding sub-bands, to obtain the bit allocation numbers of the coding sub-bands of the extended layer coding signals;

the extended layer coding signal vector quantization and coding unit is connected with the amplitude envelope quantization and coding unit, the extended layer bit allocation unit, the residual signal amplitude envelope generation unit, and the extended layer coding signal generation unit, and is configured to: perform normalization, vector quantization and coding on the extended layer coding signals by using the bit allocation numbers of the coding sub-bands of extended layer coding signals and the quantized amplitude envelope values of the coding sub-bands of extended layer coding signals reconstructed according to the amplitude envelope quantization indexes of the coding sub-bands of the extended layer coding signals, to obtain coded bits of the extended layer coding signals;

the bit stream multiplexer is connected with the amplitude envelope quantization and coding unit, the core layer frequency-domain coefficient vector quantization and coding unit, the extended layer coding signal vector quantization and coding unit, and is configured to packet side information bits of the core layer, the amplitude envelope coded bits of the core layer coding sub-bands, the coded bits of the core layer frequency-domain coefficients, side information bits of the extended layer, the amplitude envelope coded bits of the extended layer coding sub-bands, and the coded bits of the extended layer coding signals.

In order to solve the above problem, the present ivnention further provides a hierarchical audio decoding system, comprising: a bit stream demultiplexer, an amplitude envelope decoding unit, a core layer bit allocation unit, and a core layer decoding and inverse quantization unit; and further comprising: a residual signal amplitude envelope generation unit, an extended layer bit allocation unit, an extended layer coding signal decoding and inverse quantization unit, an total bandwidth frequency-domain coefficient recovery unit, a noise filling unit and an audio signal recovery unit; wherein, the amplitude envelope decoding unit is connected with the bit stream demultiplexer, and is configured to: decode amplitude envelope coded bits of core layer coding sub-bands and extended layer coding sub-bands which are output by the bit stream demultiplexer, to obtain amplitude envelope quantization indexes of the core layer coding sub-bands and the extended layer coding sub-bands; and if transient detection information indicates a transient signal, further rearrange the amplitude envelope quantization indexes of the core layer coding sub-bands and the extended layer coding sub-bands in an order of frequencies from small to large;

the core layer bit allocation unit is connected with the amplitude envelope decoding unit, and is configured to perform a bit allocation on the core layer coding sub-bands according to the amplitude envelope quantization indexes of the core layer coding sub-bands, to obtain bit allocation numbers of the core layer coding sub-bands;

the core layer decoding and inverse quantization unit is connected with the bit stream demultiplexer, the amplitude envelope decoding unit and the core layer bit allocation unit, and is configured to: calculate to obtain quantized amplitude envelope values of the core layer coding sub-bands according to the amplitude envelope quantization indexes of the core layer coding sub-bands, perform decoding, inverse quantization and inverse normalization process on coded bits of core layer frequency-domain coefficients output by the bit stream demultiplexer by using the bit allocation numbers and the quantized amplitude envelope values of the core layer coding sub-bands, to obtain the core layer frequency-domain coefficients;

the residual signal amplitude envelope generation unit is connected with the amplitude envelope decoding unit and the core layer bit allocation unit, and is configured to: look up a correction value statistical table of the amplitude envelope quantization indexes of the core layer residual signals according to the amplitude envelope quantization indexes of the core layer coding sub-bands and the bit allocation numbers of the corresponding core layer coding sub-bands, to obtain the amplitude envelope quantization indexes of the core layer residual signals;

the extended layer bit allocation unit is connected with the residual signal amplitude envelope generation unit and the amplitude envelope decoding unit, and is configured to: perform the bit allocation on coding sub-bands of extended layer coding signals according to the amplitude envelope quantization indexes of the core layer residual signals and the amplitude envelope quantization indexes of the extended layer coding sub-bands, to obtain bit allocation numbers of the coding sub-bands of the extended layer coding signals;

the extended layer coding signal decoding and inverse quantization unit is connected with the bit stream demultiplexer, the amplitude envelope decoding unit, the extended layer bit allocation unit and the residual signal amplitude envelope generation unit, and is configured to: calculate to obtain quantized amplitude envelope values of the coding sub-bands of the extended layer coding signals by using the amplitude envelope quantization indexes of the coding sub-bands of the extended layer coding signals, and perform the decoding, the inverse quantization, and the inverse normalization process on coded bits of the extended layer coding signals which are output by the bit stream demultiplexer by using the bit allocation numbers and the quantized amplitude envelope values of the coding sub-bands of the extended layer coding signals, to obtain the extended layer coding signals;

the total bandwidth frequency-domain coefficient recovery unit is connected with the core layer decoding and inverse quantization unit and the extended layer coding signal decoding and inverse quantization unit, and is configured to: rearrange the extended layer coding signals output by the extended layer coding signal decoding and inverse quantization unit in an order of the sub-bands, and then add them with the core layer frequency-domain coefficients output by the core layer decoding and inverse quantization unit, to obtain the frequency-domain coefficients of the total bandwidth;

the noise filling unit is connected with the total bandwidth frequency-domain coefficient recovery unit and the amplitude envelope decoding unit, and is configured to perform noise filling on sub-bands to which coded bits are not allocated in the process of coding;

the audio signal recovery unit is connected with the noise filling unit, and is configured to: if the transient detection information indicates a steady-state signal, directly perform an inverse time-frequency transform on the frequency-domain coefficients of the total bandwidth, to obtain an audio signal for output; and if the transient detection information indicates a transient signal, rearrange the frequency-domain coefficients of the total bandwidth, then divide into M groups of frequency-domain coefficients, perform the inverse time-frequency transform on each group of frequency-domain coefficients, and calculate to obtain a final audio signal according to M groups of time-domain signals obtained by transformation.

In conclusion, in the present invention, by introducing a processing method for transient signal frames in the hierarchical audio coding and decoding methods, a segmented time-frequency transform is performed on the transient signal frames, and then the frequency-domain coefficients obtained by transformation are rearranged respectively within the core layer and within the extended layer, so as to perform the same subsequent coding processes, such as bit allocation, frequency-domain coefficient coding, etc., as those on the steady-state signal frames, thus enhancing the coding efficiency of the transient signal frames and improving the quality of the hierarchical audio coding and decoding.

PREFERRED EMBODIMENTS OF THE PRESENT INVENTION

The primary idea of the hierarchical audio coding and decoding method and system according to the present invention is to, by introducing a processing method for transient signal frames in the hierarchical audio coding and decoding methods, perform segmented time-frequency transform on the transient signal frames, and then rearrange frequency-domain coefficients obtained by transformation within the core layer and within the extended layer respectively, so as to perform the same subsequent coding processes, such as bit allocation, frequency-domain coefficient coding, etc., as those on the steady-state signal frames, thereby enhancing coding efficiency of the transient signal frames and improving the quality of the hierarchical audio coding and decoding.

Coding Method and System

Figure 1:
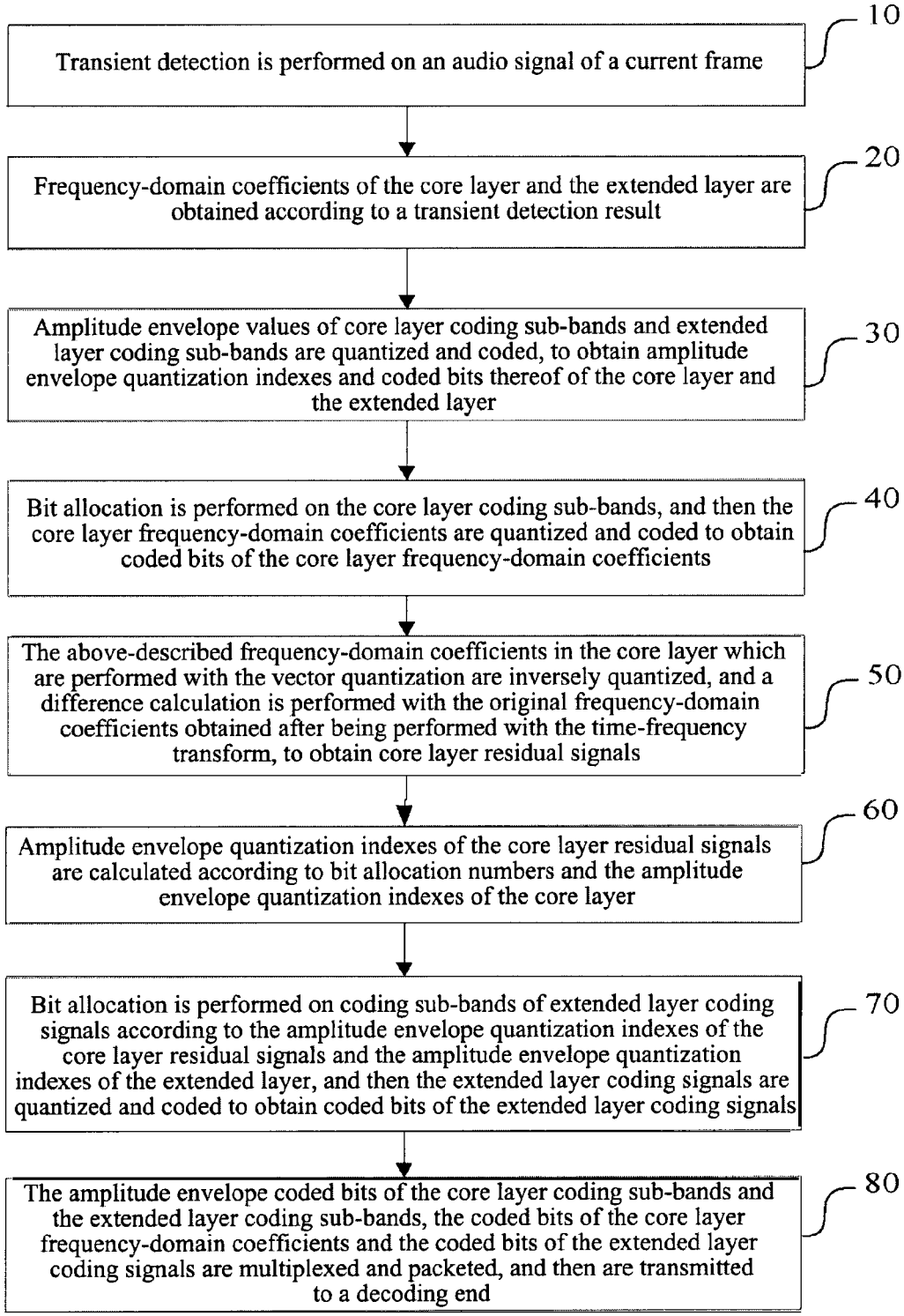
FIG. 1 is a schematic diagram of a hierarchical audio coding method according to the present invention.

As shown in FIG. 1, based on the above inventive idea, the hierarchical audio coding method according to the present invention comprises the following steps.

In step 10, a transient detection is performed on an audio signal of a current frame.

In step 20, the audio signal is processed according to a transient detection result, to obtain frequency-domain coefficients of a core layer and an extended layer.

Specifically, when the transient detection is to be a steady-state signal, time-frequency transform is performed on an audio signal to obtain total frequency-domain coefficients; when the transient detection is to be a transient signal, the audio signal is divided into M sub-frames, the time-frequency transform is performed on each sub-frame, and the M groups of frequency-domain coefficients obtained by transformation constitute the total frequency-domain coefficients of the current frame; and the total frequency-domain coefficients are rearranged so that their corresponding coding sub-bands are aligned from low frequencies to high frequencies; wherein, the total frequency-domain coefficients comprise core layer frequency-domain coefficients and extended layer frequency-domain coefficients, the coding sub-bands comprise core layer coding sub-bands and extended layer coding sub-bands, the core layer frequency-domain coefficients constitute several core layer coding sub-bands, and the extended layer frequency-domain coefficients constitute several extended layer coding sub-bands.

when the transient detection is to be the transient signal, the method for obtaining the total frequency-domain coefficients of the current frame comprises:

combining an N-point time-domain-sampled signal x(n) of the current frame and an N-point time-domain-sampled signal $x_{old}(n)$ of the last frame into a 2N-point time-domain-sampled signal $\bar{x}(n)$, and then performing windowing and time-domain aliasing processing on $\bar{x}(n)$ to obtain an N-point time-domain-sampled signal $\tilde{x}(n)$; and performing a reversing processing on the time-domain signal $\tilde{x}(n)$, subsequently, adding a sequence of zeros at both ends of the signal respectively, dividing the lengthened signal into M sub-frames which are overlapped with each other, and then performing the windowing, the time-domain aliasing processing and the time-frequency transform on the time-domain signal of each sub-frame to obtain M groups of frequency-domain coefficients and then constitute the total frequency-domain coefficients of the current frame.

When the transient detection is to be the transient signal, and when the frequency-domain coefficients are rearranged, the frequency-domain coefficients are rearranged so that their corresponding coding sub-bands are aligned from low frequencies to high frequencies within the core layer and within the extended layer respectively.

In step 30, amplitude envelope values of the core layer coding sub-bands and the extended layer coding sub-bands are quantized and coded, to obtain amplitude envelope quantization indexes and coded bits of the core layer coding sub-bands and the extended layer coding sub-bands.

Specifically, the amplitude envelope values of the core layer coding sub-bands and the extended layer coding sub-bands are quantized and coded, to obtain the amplitude envelope quantization indexes and coded bits of the core layer coding sub-bands and the extended layer coding sub-bands; wherein, if it is the steady-state signal, the amplitude envelope values of the core layer coding sub-bands and the extended layer coding sub-bands are quantized jointly; and if it is the transient signal, the amplitude envelope values of the core layer coding sub-bands and the extended layer coding sub-bands are performed individual quantization separately, and the amplitude envelope quantization indexes of the core layer coding sub-bands and the amplitude envelope quantization indexes of the extended layer coding sub-bands are rearranged respectively.

Rearranging the amplitude envelope quantization indexes specifically comprises:

rearranging the amplitude envelope quantization indexes of the coding sub-bands belonging to the same sub-frame together so that their corresponding frequencies are aligned in an ascending or descending order, and connecting the amplitude envelope quantization indexes at sub-frame boundaries by using two coding sub-bands which comprise peer-to-peer frequencies and belong to two sub-frames respectively.

When the transient detection is to be a steady-state signal, Huffman coding is performed on the amplitude envelope quantization indexes of the core layer coding sub-bands obtained by the quantization, and if the total number of bits consumed after the Huffman coding is performed on the amplitude envelope quantization indexes of all the core layer coding sub-bands is less than the total number of bits consumed after natural coding is performed on the amplitude envelope quantization indexes of all the core layer coding sub-bands, the Huffman coding is used, otherwise, the natural coding is used and the Huffman coding flag of the amplitude envelope of the core layer coding sub-bands is set; and the Huffman coding is performed on the amplitude envelope quantization indexes of the extended layer coding sub-bands obtained by the quantization, and if the total number of bits consumed after the Huffman coding is performed on the amplitude envelope quantization indexes of all the extended layer coding sub-bands is less than the total number of bits consumed after the natural coding is performed on the amplitude envelope quantization indexes of all the extended layer coding sub-bands, the Huffman coding is used, otherwise, the natural coding is used, and the Huffman coding flag of the amplitude envelopes of the extended layer coding sub-bands is set.

In step 40, the bit allocation is performed on the core layer coding sub-bands according to the amplitude envelope quantization indexes of the core layer coding sub-bands, and then the core layer frequency-domain coefficients are quantized and coded to obtain coded bits of the core layer frequency-domain coefficients.

The method for obtaining the coded bits of the core layer frequency-domain coefficients comprises:

performing normalization on the core layer frequency-domain coefficients according to the quantized amplitude envelope values of the core layer coding sub-bands which are reconstructed from the amplitude envelope quantization indexes of the core layer coding sub-bands, and performing quantization and coding by using a pyramid lattice vector quantization method and a spherical lattice vector quantization method respectively according to bit allocation numbers of the coding sub-bands, to obtain the coded bits of the core layer frequency-domain coefficients;

performing Huffman coding on the quantization indexes of the core layer which are obtained by using the pyramid lattice vector quantization;

if the total number of bits consumed after the Huffman coding is performed on all the quantization indexes obtained by using the pyramid lattice vector quantization is less than the total number of bits consumed after the natural coding is performed on all the quantization indexes obtained by using the pyramid lattice vector quantization, the Huffman coding is used, a correction is performed on the bit allocation numbers of the core layer coding sub-bands by using the number of bits saved by the Huffman coding, the number of bits remained after the first bit allocation, and the total number of bits saved by coding all the coding sub-bands in which the number of bits allocated to a single frequency-domain coefficient is 1 or 2, and the vector quantization and Huffman coding are performed again on the core layer coding sub-bands for which the bit allocation numbers are corrected; otherwise, the natural coding is used, the correction is performed on the bit allocation numbers of the core layer coding sub-bands by using the number of bits remained after the first bit allocation and the total number of bits saved by coding all the coding sub-bands in which the number of bits allocated to the single frequency-domain coefficient is 1 or 2, and the vector quantization and natural coding are performed again on the core layer coding sub-bands for which the bit allocation numbers are corrected.

In step 50, the above-described frequency-domain coefficients on which the vector quantization is performed in the core layer are inversely quantized, and a difference calculation is performed between the inversely quantized frequency-domain coefficients and the original frequency-domain coefficients obtained after being performed the time-frequency transform, to obtain core layer residual signals.

In step 60, amplitude envelope quantization indexes of the core layer residual signals are calculated according to the amplitude envelope quantization indexes of the core layer coding sub-bands and the bit allocation numbers of the core layer coding sub-bands.

The amplitude envelope quantization indexes of the coding sub-bands of the core layer residual signals are calculated by using the following method:

calculating a correction value of the amplitude envelope quantization index of the core layer residual signal according to the bit allocation number of the core layer coding sub-band; and calculating a difference between the amplitude envelope quantization index of the core layer coding sub-band and the correction value of the amplitude envelope quantization index of the core layer residual signal which corresponds to the above coding sub-band, to obtain the amplitude envelope quantization index of the core layer residual signal.

The correction value of the amplitude envelope quantization index of the core layer residual signal of each coding sub-bands are larger than or equal to 0 and does not decrease when the bit allocation number of the corresponding core layer coding sub-band increases; and when the bit allocation number of a certain core layer coding sub-band is 0, the correction value of the amplitude envelope quantization index of the core layer residual signal is 0, and when the bit allocation number of a certain core layer coding sub-band is a defined maximum bit allocation number, the amplitude envelope value of the corresponding core layer residual signal is 0.

In step 70, the bit allocation is performed on the coding sub-bands of the extended layer coding signals according to the amplitude envelope quantization indexes of the core layer residual signals and the amplitude envelope quantization indexes of the extended layer coding sub-bands, and then the extended layer coding signals are quantized and coded to obtain the coded bits of the extended layer coding signals, wherein, the extended layer coding signals are comprised of the core layer residual signals and the extended layer frequency-domain coefficients.

The method for obtaining the coded bits of the extended layer coding signals comprises:

performing normalization on the extended layer coding signals according to the quantized amplitude envelope values of the coding sub-bands of the extended layer coding signals reconstructed from the amplitude envelope quantization indexes of the coding sub-bands of the extended layer coding signals, and performing quantization and coding according to the bit allocation numbers of various coding sub-bands of the extended layer coding signals by using the pyramid lattice vector quantization method and the spherical lattice vector quantization method respectively, to obtain the coded bits of the extended layer coding signals.

In the process of performing quantization and coding on the core layer frequency-domain coefficients and the extended layer coding signals, a vector to be quantized of the coding sub-band of which the bit allocation number is less than a classification threshold is quantized and coded by using the pyramid lattice vector quantization method, and a vector to be quantized of the coding sub-band of which the bit allocation number is larger than a classification threshold is quantized and coded by using the spherical lattice vector quantization method;

the bit allocation number is the number of bits which is allocated to a single coefficient in one coding sub-band.

It can be understood that, for the extended layer coding signals, the coding signals are comprised of the core layer residual signals and the extended layer frequency-domain coefficients; and in a sense, the core layer residual signals are also comprised of coefficients.

The Huffman coding is performed on all the quantization indexes of the extended layer which are obtained by using the pyramid lattice vector quantization;

if the total number of bits consumed after the Huffman coding is performed on all the quantization indexes obtained by using the pyramid lattice vector quantization is less than the total number of bits consumed after the natural coding is performed on all the quantization indexes obtained by using the pyramid lattice vector quantization, the Huffman coding is used, a correction is performed on the bit allocation numbers of the coding sub-bands of the extended layer coding signals by using the number of bits saved by the Huffman coding, the number of bits remained after the first bit allocation, and the total number of bits saved by coding all the coding sub-bands in which the number of bits allocated to a single frequency-domain coefficient is 1 or 2, and the vector quantization and Huffman coding are performed again on the coding sub-bands of the extended layer coding signals for which the bit allocation numbers are corrected; otherwise, the natural coding is used, the correction is performed on the bit allocation numbers of the coding sub-bands of the extended layer coding signals by using the number of bits remained after the first bit allocation, and the total number of bits saved by coding all the coding sub-bands in which the number of bits allocated to a single frequency-domain coefficient is 1 or 2, and the vector quantization and natural coding are performed again on the coding sub-bands of the extended layer coding signals for which the bit allocation numbers are corrected.

When performing the bit allocation on the core layer coding sub-bands and the coding sub-bands of the extended layer coding signals, the bit allocation with variable step length is performed on the various coding sub-bands according to the amplitude envelope quantization indexes of the coding sub-bands.

In the process of the bit allocation, the step length is 1 bit of allocating a bit to an coding sub-band of which the bit allocation number is 0, and the step length of which the importance is reduced after the bit allocation is 1; the step length for the bit allocation is 0.5 bit when a bit is additionally allocated to an coding sub-band of which a bit allocation number is larger than 0 and less than the classification threshold, and the step length of which the importance is reduced after the bit allocation is 0.5; and the step length for the bit allocation is 1 when a bit is additionally allocated to an coding sub-band of which a bit allocation number is larger than or equal to the classification threshold, and the step length of which the importance is reduced after the bit allocation is 1.

The process of performing the correction on the bit allocation numbers of the coding sub-bands is as follows:

calculating the number of bits available for the correction; and searching for an coding sub-band with the maximum importance in all the coding sub-bands, if the number of bits allocated to that coding sub-band has reached a maximum value which may be allocated and given, adjusting the importance of that coding sub-band to be lowest, and no longer correcting the bit allocation number for that coding sub-band; otherwise, performing the bit allocation correction on that coding sub-band with the maximum importance.

In the process of the bit allocation correction, 1 bit is allocated to an coding sub-band in which a bit allocation number is 0, and the importance after the bit allocation is reduced by 1; 0.5 bit is allocated to an coding sub-band in which a bit allocation number is larger than 0 and is less than 5, and the importance after the bit allocation is reduced by 0.5; and 1 bit is allocated to an coding sub-band with a bit allocation number is larger than 5, and the importance after the bit allocation is reduced by 1.

when the bit allocation number is corrected once every time, iterative times count of the bit allocation correction is added by 1, and when the iterative times count of the bit allocation correction reaches a preset upper limit value or when the remaining bit number available for the correction is less than the bit number required by the bit allocation correction, the process of the bit allocation correction ends.

In step 80, the amplitude envelope coded bits of the coding sub-bands of the core layer and the extended layer, the coded bits of the core layer frequency-domain coefficients and the coded bits of the extended layer coding signals are multiplexed and packeted, and then are transmitted to a decoding end.

The multiplexing and packeting are performed in accordance with the following bit stream format:

firstly, writing side information bits of the core layer behind the frame head of the bit streams, writing the amplitude envelope coded bits of the core layer coding sub-bands into a bit stream multiplexer (MUX), and then writing the coded bits of the core layer frequency-domain coefficients into the MUX;

then, writing the side information bits of the extended layer into the MUX, then writing the amplitude envelope coded bits of the coding sub-bands of the extended layer frequency-domain coefficients into the MUX, and then writing the coded bits of the extended layer coding signals into the MUX; and transmitting the number of bits which meets the requirement on the bit rate to the decoding end according to the required bit rate.

The present invention will be described in detail in combination with the accompanying drawings and embodiments hereinafter.

Figure 2:
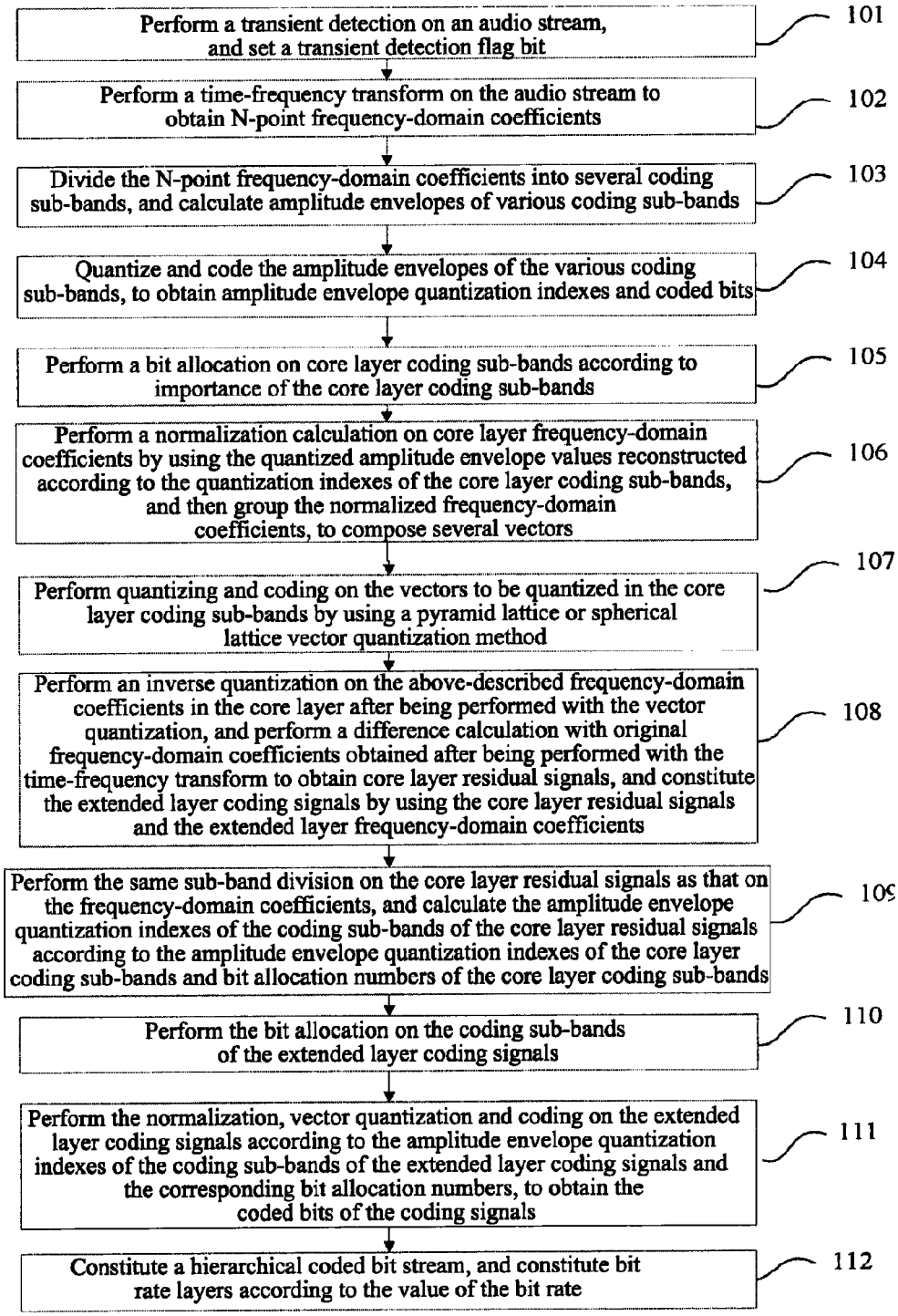
FIG. 2 is a flow chart of a hierarchical audio coding method according to an embodiment of the present invention.

FIG. 2 is a flow chart of a hierarchical audio coding method according to a first embodiment of the present invention. In the present embodiment, the hierarchical audio coding method according to the present invention is illustrated specifically by taking an audio stream with a frame length of 20 ms and a sampling rate of 32 kHz for example. Under conditions of other frame lengths and sampling rates, the method of the present invention is also applicable. As shown in FIG. 2, the method comprises the following steps.

In 101, a transient detection is performed on the audio stream with the frame length of 20 ms and the sampling rate of 32 kHz, to judge whether that frame of audio signal is a transient signal or a steady-state signal, and when the frame of signal is determined as the transient signal, a transient detection flag bit Flag_transient is set as Flag_transient=1; and when the frame of signal is determined as a steady-state signal, the transient detection flag bit Flag_transient is set as Flag_transient=0.

The transient detection technology used by the present invention can be a simple threshold detection method, or can be some more complex technologies, including but not limited to a perceptual entropy method, a multi-detection method, and so on.

In 102, a time-frequency transform is performed on the audio stream with the frame length of 20 ms and the sampling rate of 32 kHz, to obtain N frequency-domain coefficients at frequency-domain sampled points.

A specific implementation mode of the present step can be as follows.

A 2N-point time-domain-sampled signal $\bar{x}(n)$ is composed of a N-point time-domain-sampled signal x(n) of the current frame and a N-point time-domain-sampled signal $x_{old}(n)$ of the last frame, and the 2N-point time-domain-sampled signal can be represented by the following equation:

$$\bar{x}(n) = \begin{cases} x_{old}(n) & n = 0, 1, \ldots, N-1 \\ x(n-N) & n = N, N+1, \ldots, 2N-1 \end{cases} \quad (1)$$

A windowing process is performed on $\bar{x}(n)$ to obtain a windowed signal:

$$x_w(n) = h(n)\bar{x}(n) \quad (2)$$

wherein, h(n) is a window function, and is defined as:

$$h(n) = \sin\left[\left(n + \frac{1}{2}\right)\frac{\pi}{2N}\right] \quad (3)$$
$$n = 0, \ldots, 2N - 1$$

The windowed frame of signal $x_w$ of 40 ms is transformed into a signal $\tilde{x}$ with a frame length of 20 ms by using a time-domain aliasing processing, and the operation method is as follows:

$$\tilde{x} = \begin{bmatrix} 0 & 0 & -J_{N/2} & -I_{N/2} \\ I_{N/2} & -J_{N/2} & 0 & 0 \end{bmatrix} x_w \quad (4)$$

wherein, $$I_{N/2} = \begin{bmatrix} 1 & & 0 \\ & \ddots & \\ 0 & & 1 \end{bmatrix}_{(N/2)\times(N/2)}, \quad J_{N/2} = \begin{bmatrix} 0 & & 1 \\ & \iddots & \\ 1 & & 0 \end{bmatrix}_{(N/2)\times(N/2)}$$

If the transient detection flag bit Flag_transient is 0, it is indicated that the current frame is a steady-state signal, and an IV class of Discrete Cosine Transform ($DCT_{IV}$ transform) or other classes of discrete cosine transform are directly performed on the time-domain aliasing signal $\tilde{x}(n)$, to obtain the following frequency-domain coefficient:

$$Y(k) = \sum_{n=0}^{N-1} \tilde{x}(n)\cos\left[\left(n + \frac{1}{2}\right)\left(k + \frac{1}{2}\right)\frac{\pi}{N}\right] \quad (5)$$
$$k = 0, \ldots, N - 1$$

If the transient detection flag bit Flag_transient is 1, it is indicated that the current frame is a transient signal, and it is needed to firstly perform a reversing processing on the time-domain aliasing signal $\tilde{x}(n)$ to decrease parasitic time-domain and frequency-domain responses. Subsequently, a sequence of zeros with a length of N/8 is added at both ends of the signal respectively, the lengthened signal is divided into 4 sub-frames which are overlapped with each other and have the same length. The length of each sub-frame is N/2 and the sub-frames are overlapped with each other with a proportion of 50%. Windowing is performed on each of two intermediate sub-frames by using a sine window with a length of N/2, and for each of two sub-frames at both ends, windowing is performed on the inside half of the sub-frame using a half of sine window with a length of N/4. Then, the time-domain aliasing processing and $DCT_{IV}$ transform are performed on each windowed sub-frame of signal, to obtain 4 groups of frequency-domain coefficients with a length of N/4 and constitute the frequency-domain coefficient Y(k), k=0, . . . , N−1 with a total length of N.

In addition, when the frame length is 20 ms and the sampling rate is 32 kHz, N=640 (the corresponding N can also be calculated regarding to another frame length and another sampling rate).

In 103, the N-point frequency-domain coefficients are divided into several coding sub-bands, and frequency-domain amplitude envelopes (amplitude envelope for short) of all coding sub-bands are calculated.

The dividing of the frequency-domain coefficients into coding sub-bands can be even or uneven; and in the present embodiment, it is uneven.

The present step can be implemented by using the following sub-steps.

In 103*a*, the frequency-domain coefficients in the frequency range needed to be coded are divided into L sub-bands (which can be referred to as the coding sub-bands).

In the present embodiment, the frequency range needed to be coded is 0~13.6 kHz, and the sub-bands can be obtained by uneven dividing according to the characteristic of human ear perception. Table 1 and Table 2 respectively give one specific dividing mode when the transient detection flag bit Flag_transient is 0 and 1.

In Table 1 and Table 2, the frequency-domain coefficients in the frequency range of 0~13.6 kHz are divided into 30 coding sub-bands, i.e., L=30; and the frequency-domain coefficients over 13.6 kHz are set as 0.

In the present embodiment, the frequency range of the core layer is further obtained by dividing. When the transient detection flag bit Flag_transient is 0 and 1, sub-bands numbered with 0~17 in Table 1 and Table 2 are selected as sub-bands of the core layer respectively, and the number of the core layer coding sub-bands is L_core=18. The frequency range of the core layer is 0~7 kHz.

When the transient detection flag bit Flag_transient is 1, 4 groups of frequency-domain coefficients in the frequency range needed to be coded are divided into sub-bands, and then the frequency-domain coefficients in the frequency range of the core layer and the frequency range of the extended layer are rearranged respectively so that their corresponding coding sub-bands are aligned from low frequencies to high frequencies. When the remaining frequency-domain coefficients in a group is not enough to constitute one sub-band (such as in Table 2, less than 16), the frequency-domain coefficients with the same or similar frequencies in the next group of frequency-domain coefficients are used for supplement, such as sub-bands 16 and 17 of the core layer in Table 2. The coding sub-bands in Table 2 are one specific result of completed rearrangement.

It can be understood that, the frequency-domain coefficients constituting the core layer coding sub-bands are referred to as core layer frequency-domain coefficients, and the frequency-domain coefficients constituting extended layer coding sub-bands are referred to as extended layer frequency-domain coefficients; or it can also be described as that the frequency-domain coefficients are divided into core layer frequency-domain coefficients and extended layer frequency-domain coefficients, the core layer frequency-domain coefficients are divided into several core layer coding sub-bands, and the extended layer frequency-domain coefficients are divided into several extended layer coding sub-bands. It can be understood that an order of dividing of the frequency-domain coefficient layer (referred to as the core layer and the extended layer) and dividing of the coding sub-bands does not influence the implementation of the present invention.

TABLE 1

Example of dividing sub-bands when the transient detection flag bit Flag_transient is 0

| Sub-band serial number | Index of starting frequency-domain coefficient (LIndex) | Index of ending frequency-domain coefficient (HIndex) | Sub-band width (BandWidth) |
|---|---|---|---|
| 0 | 0 | 15 | 16 |
| 1 | 16 | 31 | 16 |
| 2 | 32 | 47 | 16 |
| 3 | 48 | 63 | 16 |
| 4 | 64 | 79 | 16 |
| 5 | 80 | 95 | 16 |
| 6 | 96 | 111 | 16 |

TABLE 1-continued

| Example of dividing sub-bands when the transient detection flag bit Flag_transient is 0 | | | |
|---|---|---|---|
| Sub-band serial number | Index of starting frequency-domain coefficient (LIndex) | Index of ending frequency-domain coefficient (HIndex) | Sub-band width (BandWidth) |
| 7 | 112 | 127 | 16 |
| 8 | 128 | 143 | 16 |
| 9 | 144 | 159 | 16 |
| 10 | 160 | 175 | 16 |
| 11 | 176 | 191 | 16 |
| 12 | 192 | 207 | 16 |
| 13 | 208 | 223 | 16 |
| 14 | 224 | 239 | 16 |
| 15 | 240 | 255 | 16 |
| 16 | 256 | 271 | 16 |
| 17 | 272 | 287 | 16 |
| 18 | 288 | 303 | 16 |
| 19 | 304 | 319 | 16 |
| 20 | 320 | 335 | 16 |
| 21 | 336 | 351 | 16 |
| 22 | 352 | 367 | 16 |
| 23 | 368 | 383 | 16 |
| 24 | 384 | 399 | 16 |
| 25 | 400 | 415 | 16 |
| 26 | 416 | 447 | 32 |
| 27 | 448 | 479 | 32 |
| 28 | 480 | 511 | 32 |
| 29 | 512 | 543 | 32 |

TABLE 2

| Example of dividing sub-bands when the transient detection flag bit Flag_transient is 1 | | | |
|---|---|---|---|
| Sub-band serial number | Index of starting frequency-domain coefficient (LIndex) | Index of ending frequency-domain coefficient (HIndex) | Sub-band width (BandWidth) |
| 0 | 0 | 15 | 16 |
| 1 | 160 | 175 | 16 |
| 2 | 320 | 335 | 16 |
| 3 | 480 | 495 | 16 |
| 4 | 16 | 31 | 16 |
| 5 | 176 | 191 | 16 |
| 6 | 336 | 351 | 16 |
| 7 | 496 | 511 | 16 |
| 8 | 32 | 47 | 16 |
| 9 | 192 | 207 | 16 |
| 10 | 352 | 367 | 16 |
| 11 | 512 | 527 | 16 |
| 12 | 48 | 63 | 16 |
| 13 | 208 | 223 | 16 |
| 14 | 368 | 383 | 16 |
| 15 | 528 | 543 | 16 |
| 16 | 64, 65, 66, 67, 68, 69, 70, 71, 224, 225, 226, 227, 228, 229, 230, 231 | | 16 |
| 17 | 384, 385, 386, 387, 388, 389, 390, 391, 544, 545, 546, 547, 548, 549, 550, 551 | | 16 |
| 18 | 72 | 87 | 16 |
| 19 | 232 | 247 | 16 |
| 20 | 392 | 407 | 16 |
| 21 | 552 | 567 | 16 |
| 22 | 88 | 103 | 16 |
| 23 | 248 | 263 | 16 |
| 24 | 408 | 423 | 16 |
| 25 | 568 | 583 | 16 |
| 26 | 104 | 135 | 32 |
| 27 | 264 | 295 | 32 |
| 28 | 424 | 455 | 32 |
| 29 | 584 | 615 | 32 |

In 103*b*, amplitude envelope values of coding sub-bands are calculated according to the following equation:

$$Th(j) = \sqrt{\frac{1}{HIndex(j) - LIndex(j) + 1} \sum_{k=LIndex(j)}^{HIdex(j)} X(k)X(k)} \quad (6)$$

$$j = 0, 1, \ldots, L-1$$

wherein, LIndex(j) and HIndex(j) represents the index of an starting frequency-domain coefficient and the index of an ending frequency-domain coefficient of the $j^{th}$ coding sub-band respectively, and specific values thereof are shown in Table 1 (when the transient detection flag bit Flag_transient is 0) and Table 2 (when the transient detection flag bit Flag_transient is 1).

In 104, when the transient detection flag bit Flag_transient is 1, the amplitude envelope values of the core layer coding sub-bands and the extended layer coding sub-bands are quantized and coded, to obtain amplitude envelope quantization indexes of the core layer coding sub-bands and the extended layer coding sub-bands and amplitude envelope coded bits of the core layer coding sub-bands and the extended layer coding sub-bands, wherein, the amplitude envelope coded bits of the core layer coding sub-bands and the amplitude envelope coded bits of the extended layer coding sub-bands are needed to be transmitted into a bit stream multiplexer (MUX).

When the transient detection flag bit Flag_transient is 0, the amplitude envelope values of the core layer coding sub-bands and the extended layer coding sub-bands are jointly quantized; and when the transient detection flag bit Flag_transient is 1, the amplitude envelope values of the core layer coding sub-bands and the extended layer coding sub-bands are separately quantized respectively, and the amplitude envelope quantization indexes of the core layer coding sub-bands and the amplitude envelope quantization indexes of the extended layer coding sub-bands are rearranged respectively.

The process of quantizing and coding the amplitude envelopes of the core layer coding sub-bands is illustrated in the following.

The amplitude envelope of each coding sub-band is quantized by using the following equation (7) to obtain the amplitude envelope quantization index of each coding sub-band, i.e., the output value of a quantizer:

$$Th_q(j) = \lfloor 2 \log_2 Th(j) \rfloor \; j = 0, \ldots, L_C - 1 \quad (7)$$

wherein, $$L_C = \begin{cases} \text{L_core} & \text{when Flag_transient} = 1 \\ L & \text{when Flag_transient} = 0, \end{cases}$$

and $\lfloor x \rfloor$ represents rounding down. $Th_q(0)$ is an amplitude envelope quantization index of a first core layer coding sub-band, and a range thereof is limited within [−5, 34], i.e., when $Th_q(0) < -5$, make $Th_q(0) = -5$; and when $Th_q(0) > 34$, make $Th_q(0) = 34$.

When the transient detection flag bit Flag_transient is 1, the amplitude envelope quantization indexes of the core layer coding sub-bands are rearranged, so that the following differential coding of amplitude envelope quantization indexes of the core layer coding sub-bands has a higher efficiency.

The specific example of rearranging is shown in Table 3.

TABLE 3

Example of rearranging the amplitude envelopes of the core layer

| Sub-band serial number | Corresponding serial number after rearranging |
|---|---|
| 0 | 0 |
| 1 | 8 |
| 2 | 9 |
| 3 | 17 |
| 4 | 1 |
| 5 | 7 |
| 6 | 10 |
| 7 | 16 |
| 8 | 2 |
| 9 | 6 |
| 10 | 11 |
| 11 | 15 |
| 12 | 3 |
| 13 | 5 |
| 14 | 12 |
| 15 | 14 |
| 16 | 4 |
| 17 | 13 |

The amplitude envelope quantization index $Th_q(0)$ of the first coding sub-band is coded by using 6 bits, i.e., consuming 6 bits.

Differential operation values between the amplitude envelope quantization indexes of the core layer coding sub-bands are calculated using the following equation:

$$\Delta Th_q(j)=Th_q(j+1)-Th_q(j)\ j=0, \ldots, L_\text{core}-2 \quad (8)$$

The amplitude envelope can be corrected as follows, to ensure that the range of the $\Delta Th_q(j)$ is within [−15, 16]:

if $\Delta Th_q(j)<-15$, then make that $\Delta Th_q(j)=-15$, $Th_q(j)=Th_q(j+1)+15$, j=L_core−2, . . . , 0;

if $\Delta Th_q(j)>16$, then make that $\Delta Th_q(j)=16$, $Th_q(j+1)=Th_q(j)+16$, j=0, . . . , L_core−2;

The Huffman coding is performed on $\Delta Th_q(j)$, j=0, . . . , L_core−2, and the number of bits consumed at the time (referred to as Huffman coded bits) is calculated. If the Huffman coded bits at the time are larger than or equal to the number of bits allocated fixedly (which are larger than or equal to (L_core−1)×5) in the present embodiment), the Huffman coding mode is not used to code $\Delta Th_q(j)$, j=0, . . . , L_core−2, and the Huffman coding flag bit is set as Flag_huff_rms_core=0; otherwise, the Huffman coding is used to code $\Delta Th_q(j)$, j=0, . . . , L_core−2, and the Huffman coding flag bit is set as Flag_huff_rms_core=1. The coded bits of the amplitude envelope quantization indexes of the core layer coding sub-bands (i.e., coded bits of amplitude envelope differential values and an amplitude envelope of the first sub-band) and the Huffman coding flag bit are needed to be transmitted into the MUX.

The process of quantizing and coding the amplitude envelopes of the extended layer coding sub-bands will be illustrated in the following.

When the transient detection flag bit Flag_transient is 0, the Huffman coding is performed on the amplitude envelope differential values $\Delta Th_q(j)$, j=L_core−1, . . . , L−2, and the number of bits consumed at the time (referred to as Huffman coded bits) is calculated. If the Huffman coded bits at the time are larger than or equal to the number of the bits allocated fixedly (which are larger than or equal to (L−L_core)×5 in the present embodiment), the Huffman coding mode is not used to code $\Delta Th_q(j)$, j=L_core−1, . . . , L−2, and the Huffman coding flag bit is set as Flag_huff_rms_ext=0; otherwise, the Huffman coding is used to code $\Delta Th_q(j)$, j=L_core−1, . . . , L−2, and the Huffman coding flag bit is set as Flag_huff_rms_ext=1.

When the transient detection flag bit Flag_transient is 1, the amplitude envelopes of the extended layer coding sub-bands is quantized in accordance with the following equation, to obtain the amplitude envelope quantization indexes of the extended layer coding sub-bands, i.e., the output values of the quantizer:

$$Th_q(j)=\lfloor 2\log_2 Th(j)\rfloor\ j=L_\text{core}, \ldots, L-1 \quad (9)$$

wherein, $Th_q(L_core)$ is an amplitude envelope quantization index of a first coding sub-band comprised by the extended layer frequency-domain coefficients, and the range thereof is limited within [−5, 34]. The amplitude envelope quantization indexes of the extended layer coding sub-bands are rearranged, so that the following differential coding of amplitude envelope quantization indexes of the coding sub-bands of the extended layer has a higher efficiency. The specific example of rearranging is shown in Table 4.

TABLE 4

Example of rearranging the amplitude envelopes of the extended layer coding sub-bands

| Sub-band serial number | Corresponding serial number after rearranging |
|---|---|
| 18 | 18 |
| 19 | 23 |
| 20 | 24 |
| 21 | 29 |
| 22 | 19 |
| 23 | 22 |
| 24 | 25 |
| 25 | 28 |
| 26 | 20 |
| 27 | 21 |
| 28 | 26 |
| 29 | 27 |

The amplitude envelope quantization index $Th_q(L_core)$ of the first coding sub-band comprised by extended layer frequency-domain coefficients is coded by using 6 bits, i.e., consuming 6 bits. Differential operation values between the amplitude envelope quantization indexes of the extended layer coding sub-bands comprised by the extended layer frequency-domain coefficients are calculated using the following equation:

$$\Delta Th_q(j)=Th_q(j+1)-Th_q(j)\ j=L_\text{core}, \ldots, L-2 \quad (10)$$

The amplitude envelope can be corrected as follows, to ensure that the range of $\Delta Th_q(j)$ is within [−15, 16]:

if $\Delta Th_q(j)<-15$, make $\Delta Th_q(j)=-15$, $Th_q(j)=Th_q(j+1)+15$, j=L_core, . . . , L−2; and if $\Delta Th_q(j)>16$, make $\Delta Th_q(j)=16$, $Th_q(j+1)=Th_q(j)+16$, j=L_core, . . . , L−2. Then, the Huffman coding is performed on $\Delta Th_q(j)$, j=L_core, . . . , L−2, and the number of bits consumed at the time (referred to as Huffman coded bits) is calculated. If the Huffman coded bits at the time are larger than or equal to the number of bits allocated fixedly (which are larger than or equal to (L−L_core−1)×5 in the present embodiment), the Huffman coding mode is not used to code $\Delta Th_q(j)$, j=L_core, . . . , L−2, and the Huffman coding flag bit is set as Flag_huff_rms_ext=0; otherwise, the Huffman coding is used to code $\Delta Th_q(j)$, j=L_core, . . . , L−2, and the Huffman coding flag bit is set as Flag_huff_rms_ext=1.

The coded bits of the amplitude envelope quantization indexes and the Huffman coding flag bit of the extended layer are needed to be transmitted into the MUX.

In 105, initial values of importance of the core layer coding sub-bands are calculated according to the rate distortion theory and amplitude envelope information of the core layer coding sub-bands, and then the bit allocation of the core layer is performed according to the importance of the core layer coding sub-bands.

The present step can be implemented by the following sub-steps.

In 105*a*, an average value of bit consumption of a single frequency-domain coefficient of the core layer is calculated.

The number of bits bits_available_core used for the coding of the core layer is extracted from the total number of bits bits_available which can be provided by a frame length of 20 ms, and the number of remaining bits bits_left_core available for the coding of the core layer frequency-domain coefficients can be obtained by removing the number of bits bit_sides_core consumed by the side information of the core layer and the number of bits bits_Th_core consumed by the amplitude envelope quantization indexes of the core layer coding sub-bands, i.e.:

$$\text{bits_left_core}=\text{bits_available_core}-\text{bit_sides_core}-\text{bits_}Th\text{_core} \tag{11}$$

The side information comprises bits of Huffman coding flags Flag_huff_rms_core, Flag_huff_PLVQ_core and the iterative times count_core. Flag_huff_rms_core is used to identify whether the Huffman coding is used for the amplitude envelope quantization indexes of the core layer coding sub-bands; Flag_huff_PLVQ_core is used to identify whether the Huffman coding is used when the vector coding is performed on the core layer frequency-domain coefficients, and the iterative times count_core is used to identify the iterative times when the bit allocation of the core layer is corrected (see the description in the subsequent steps in detail).

The average value of the bit consumption of the single frequency-domain coefficient of the core layer is calculated as $\overline{R}$_core:

$$\overline{R}\text{_core} = \frac{\text{bits_left_core}}{HIndex(\text{L_core}-1)+1} \tag{12}$$

wherein, L_core is the number of the core layer coding sub-bands.

In 105*b*, an optimal bit value under a condition of a maximum quantized signal to noise ratio gain is calculated according to the bit rate distortion theory.

The optimal bit value under the condition of the maximum quantized signal to noise ratio gain of each coding sub-band under the boundary of bit rate distortion degree can be calculated and obtained by optimizing the bit rate distortion degree based on an independent Gaussian random variable by using the Lagrange method as:

$$rr_\text{core}(j)=[\overline{R}_core+R_{min}_\text{core}(j)],\ j=0,\ldots,L_\text{core}-1 \tag{13}$$

wherein, $$R_{min}_\text{core}(j) = \frac{1}{2}[Th_q(j) - \text{mean_Th}_q\text{_core}] \tag{14}$$

$$j = 0, \ldots, \text{L_core} - 1$$

and $$\text{mean_Th}_q\text{_core} = \frac{1}{HIndex(\text{L_core}-1)+1}\sum_{i=0}^{L_core-1} Th_q(i)[HIndex(i) - LIndex(i) + 1] \tag{15}$$

In 105*c*, the initial value of the importance, when the bit allocation is performed for the core layer coding sub-bands, is calculated.

With the above optimal bit value and a proportion factor complying with the characteristic of ear perception, the initial value of the importance of the core layer coding sub-bands for controlling the bit allocation in the actual bit allocation can be obtained:

$$rk(j)=\alpha\times rr\ \text{core}(j)=\alpha[\overline{R}_core+R_{min}_\text{core}(j)],\ j=0,\ldots,L_\text{core}-1 \tag{16}$$

wherein, $\alpha$ is a proportion factor, which is related to the coded bit rate, and can be obtained by statistical analysis, normally, $0<\alpha<1$, and in the present embodiment, the value of $\alpha$ is 0.7; and rk(j) represents the importance of the $j^{th}$ coding sub-band when performing the bit allocation.

In 105*d*, the bit allocation of the core layer is performed according to the importance of the core layer coding sub-bands. The specific description is as follows.

Firstly, a core layer coding sub-band where a maximum value is located is searched from various rk(j), and it is assumed that the coding sub-band number is $j_k$, then the bit allocation number region_bit($j_k$) of each frequency-domain coefficient is added in the core layer coding sub-band, and the importance of the core layer coding sub-band is reduced; meanwhile, an total number of bits bit_band_used ($j_k$) consumed by the coding sub-band is calculated; finally, a sum of the number of bits consumed by all the core layer coding sub-bands sum(bit_band_used (j)), j=0, . . . , L_core−1 is calculated; and the above process is repeated until the sum of the number of bits consumed meets a maximum value under a condition of a bit limitation which can be provided.

The bit allocation method in the present step can be represented by the following pseudo-codes:

```
make region_bit(j)=0, j=0,1, . . ., L_core − 1;
for the coding sub-bands 0, 1, . . ., L_core−1:
{

 search for j_k = arg max[rk(j)];
                  j=0,···,L−1

make region_bit(j_k) < classification threshold
   {
   if region_bit(j_k)=0
   make region_bit(j_k) = region_bit(j_k) + 1;
      calculate bit_band_used(j_k) = region_bit(j_k) * BandWidth(j_k);
   make rk(j_k) = rk(j_k) − 1;
   or else, if region_bit(j_k)>=1
   make region_bit(j_k)) = region_bit(j_k)+ 0.5;
   calculate bit_band_used(j_k) = region_bit(j_k) * BandWidth(j_k)*0.5;
```

-continued

```
    make rk(j_k) = rk(j_k) − 0.5;
  }
  or else, if region_bit(j_k)>= classification threshold
  {
  make region_bit(j_k) = region_bit(j_k) + 1;

  make rk(j_k) = { rk(j_k) − 1   if region_bit(j_k) < MaxBit
                 { −100          else                        ;

  calculate bit_band_used(j_k) = region_bit(j_k)×BandWidth(j_k);
  }
  calculate bit_used_all = sum(bit_band_used(j))   j=0,1,. . ., L_core−1;
  if bit_used_all < bits_left_core − 16, return and re-search for j_k in various coding
sub-bands, and circularly calculate the bit allocation number (or referred to as the number of
coded bits); wherein, 16 is a maximum of the number of bits of the core layer coding
sub-bands.
  or else, end the cycle, calculate the bit allocation number, and output the current bit
allocation number.
  {
```

Finally, according to the importance of the sub-bands, the remaining bits which is less than 16 are allocated to the core layer coding sub-bands which meet the requirements in accordance with the following principle: 0.5 bit is allocated to each frequency-domain coefficient in the core layer coding sub-bands in which the bit allocation is 1, and meanwhile the importance of the core layer coding sub-bands is reduced by 0.5 until bit_left_core−bit_used_all<8, and the bit allocation ends. At the time, the finally remaining bits are recorded as remaining bits remain_bits_core initially allocated by the core layer.

The value range of the above classification threshold is larger than or equal to 2 and less than or equal to 8, and the value can be 5 in the present embodiment.

Wherein, MaxBit is a maximum bit allocation number which can be allocated to a single frequency-domain coefficient in the core layer coding sub-band, and the unit is bit/frequency-domain coefficient. In the present embodiment, MaxBit=9 is used. Such value can be suitably modified according to the coded bit rate of the codec. region_bit(j) is the number of bits allocated to a single frequency-domain coefficient in the $j^{th}$ core layer coding sub-band, i.e., is the bit allocation number of the single frequency-domain coefficient in that sub-band.

In addition, in the present step, the bit allocation of the core layer can also be performed by using $Th_q(j)$ or $\lfloor \mu \times \log_2[Th(j)]+v \rfloor$ as an initial value of the importance of the bit allocation of the core layer coding sub-band, wherein, j=0, . . . , L_core−1; μ>0.

The coding sub-bands described in the following steps 106-107 are core layer coding sub-bands.

In 106, the normalization calculation is performed on the frequency-domain coefficients in the core layer coding sub-bands by using the quantized amplitude envelope values reconstructed according to the amplitude envelope quantization indexes of the core layer coding sub-bands, and then the normalized frequency-domain coefficients are grouped, to constitute several vectors.

for all j=0, . . . , L_core−1, the normalization process is performed on all frequency-domain coefficients $X_j$ in the coding sub-band by using the quantized amplitude envelope $2^{Th_q(j)/2}$ of the coding sub-band j:

$$X_j^{normalized} = \frac{X_j}{2^{Th_q(j)/2}}; \tag{17}$$

Continuous 8 coefficients in the coding sub-band are grouped to constitute one 8-dimensional vector. According to the division of the coding sub-bands in Table 1, the coefficients in the coding sub-band j can just be grouped to constitute Lattice_D8(j) 8-dimensional vectors. The various normalized grouped 8-dimensional vectors to be quantized can be represented as $Y_j^m$, wherein, m represents a position where that 8-dimensional vector is located in the coding sub-band, and the range thereof is between 0 and Lattice_D8(j)−1.

In 107, for all j=0, . . . , L_core−1, the size of the number of bits region_bit(j) allocated to the coding sub-band j is judged, and if the allocated number of bits region_bit(j) is less than the classification threshold, the coding sub-band is referred to as the low-bit coding sub-band, and the vectors to be quantized in the low-bit coding sub-band are quantized and coded by using the pyramid lattice vector quantization method; and if the allocated number of bits region_bit(j) is larger than or equal to the threshold, the coding sub-band is referred to as the high-bit coding sub-band, and the vectors to be quantized in the high-bit coding sub-band are quantized and coded by using the spherical lattice vector quantization method; and the threshold of the present embodiment uses 5 bits.

The pyramid lattice vector quantization and coding method will be illustrated hereinafter.

The low-bit coding sub-band is quantized by using the pyramid lattice vector quantization method, and at the time, the number of bits allocated to the sub-band j meets: 1<=region_bit(j)<5.

The present invention uses a 8-dimensional lattice vector quantization based on $D_8$ grid points, wherein, the $D_8$ grid points is defined as follows:

$$D_8 = \left\{ v = (v_1, v_2, \ldots, v_8)^T \in Z^8 \,\middle|\, \sum_{i=1}^{8} v_i = \text{even} \right\} \tag{18}$$

wherein, $Z^8$ represents an 8-dimensional integer space. The basic method for mapping (quantizing) the 8-dimensional vectors to the $D_8$ grid points is described as follows:

Assuming that x is a random real number, f(x) represents rounding quantization for taking an integer which is nearer to x in both integers adjacent to x, and w(x) represents rounding quantization for taking an integer which is farther to x in both integers adjacent to x. For any vector $X=(x_1, x_2, \ldots, x_8) \in R^8$, $f(X)=(f(x_1), f(x_2), \ldots, f(x_8))$ can also be defined. In f(X), a minimum subscript in the components with maximum absolution of rounding quantization errors is selected, and is recorded as k, thereby defining $g(X)=(f(x_1), f(x_2), \ldots w(x_k), \ldots, f(x_8))$, and thus there is one and only one value is the value of the $D_8$ grid point in f(X) or g(X), and at the time, the quantization value of the $D_8$ grid point output by the quantizer is:

$$f_{D_8}(x) = \begin{cases} f(X), \text{ if } f(X) \in D_8 \\ g(X), \text{ if } g(X) \in D_8 \end{cases} \quad (19)$$

The specific steps of the method of quantizing the vectors to be quantized to the $D_8$ grid points and solving the indexes of the $D_8$ grid points are as follows.

a, the energy of the vectors to be quantized is regularized.

The energy of the vectors to be quantized needs to be regularized before the quantization. Codebook serial number index and energy scaling factors scale corresponding to the number of bits are inquired from Table 2 according to the number of bits region_bit(j) allocated to the coding sub-band j where the vectors to be quantized are located; and then the energy of the vectors to be quantized is regularized according to the following equation:

$$\tilde{Y}_{j,scale}^{m}=(Y_j^m-a)*\text{scale(index)} \quad (20)$$

wherein, $Y_j^m$ represents $m^{th}$ normalized 8-dimensional vector to be quantized in the coding sub band j, $\tilde{Y}_{j,scale}^{m}$ represents a 8-dimensional vector after regularizing the energy of the $Y_j^m$, and $a=(2^{-6}, 2^{-6}, 2^{-6}, 2^{-6}, 2^{-6}, 2^{-6}, 2^{-6}, 2^{-6})$.

TABLE 5

Corresponding relationship between the number of bits of the pyramid lattice grid vector quantization and codebook serial number, energy scaling factor, maximum pyramid surface energy radius

| the number of bits region_bit | codebook serial number Index | energy scaling factor Scale | maximum pyramid surface energy radiuse LargeK |
|---|---|---|---|
| 1 | 0 | 0.5 | 2 |
| 1.5 | 1 | 0.65 | 4 |
| 2 | 2 | 0.85 | 6 |
| 2.5 | 3 | 1.2 | 10 |
| 3 | 4 | 1.6 | 14 |
| 3.5 | 5 | 2.25 | 22 |
| 4 | 6 | 3.05 | 30 |
| 4.5 | 7 | 4.64 | 44 |

b, the regularized vectors are perform the grid point quantization;

The 8-dimensional vector $\tilde{Y}_{j,scale}^{m}$ of which the energy is regularized is quantized to the $D_8$ grid point $\tilde{Y}_j^m$:

$$\tilde{Y}_j^m=f_{D_8}(\tilde{Y}_{j,scale}^{m}) \quad (21)$$

wherein, $f_{D_8}(\bullet)$ represents a quantizing operator for mapping a certain 8-dimensional vector to the $D_8$ grid points.

c, the energy of $\tilde{Y}_{j,scale}^{m}$ is cut off according to the pyramid surface energy of the $D_8$ grid point $\tilde{Y}_j^m$.

The energy of the $D_8$ grid point $\tilde{Y}_j^m$ is calculated and is compared with a maximum pyramid surface energy radius LargeK(index) in the coding codebook. If it is not larger than the maximum pyramid surface energy radius, the index of the grid point in the codebook is calculated; otherwise, the energy of the regularized vector $\tilde{Y}_{j,scale}^{m}$ to be quantized of the coding sub-band is cut off, until the energy of the quantized grid point of the vector to be quantized of which the energy has been cut off is not larger than the maximum pyramid surface energy radius; at the time, a small energy of its own is persistently increased to the vector to be quantized of which the energy has been cut off, until its energy which is quantized to the $D_8$ grid point exceeds the maximum pyramid surface energy radius; and a last $D_8$ grid point of which the energy does not exceed the maximum pyramid surface energy radius is selected as a quantization value of the vector to be quantized. The specific process can be described by the following pseudo-codes.

the pyramid surface energy of $\tilde{Y}_j^m$ is calculated, i.e., a sum of absolutions of various components of $m^{th}$ vector in the coding sub-band j is obtained,

```
temp__K = sum(|Ỹj^m|)
Ybak = Ỹj^m
Kbak = temp__K
If temp__K> LargeK(index)
{
    While temp__K> LargeK(index)
  {
        Ỹj,scale^m = Ỹj,scale^m / 2 ,
        Ỹj^m = fD8(Ỹj,scale^m)
          temp__K = sum(|Ỹj^m|)
    }
     w = Ỹj,scale^m / 16
     Ybak = Ỹj^m
     Kbak = temp__K
    While temp__K<= LargeK(index)
    {
        Ybak = Ỹj^m
          Kbak = temp__K
        Ỹj,scale^m = Ỹj,scale^m + w
        Ỹj^m = fD8(Ỹj,scale^m)
        temp__K = sum(|Ỹj^m|)
    }
}
  Ỹj^m = Ybak
  temp__K = Kbak
```

At the time, $\tilde{Y}_j^m$ is the last $D_8$ grid point of which the energy does not exceed the maximum pyramid surface energy radius, and temp_K is the energy of that grid point.

d, quantization indexes of the $D_8$ grid points $\tilde{Y}_j^m$ in the codebook are generated.

According to the following steps, the indexes of the $D_8$ grid points $\tilde{Y}_j^m$ in the codebook are obtained by calculation. The specific steps are as follows.

In step one, the grid points on various pyramid surfaces are labeled respectively according to the size of the pyramid surface energy.

For an integer grid point grid $Z^L$ with the dimension of L, a pyramid surface with an energy radius of K is defined as:

$$S(L, K) = \left\{ Y = (y_1, y_2, \ldots, y_L) \in Z^L \middle| \sum_{i=1}^{L} |y_i| \middle| K \right\} \quad (22)$$

N(L,K) is recorded as the number of grid points in S(L,K), and for the integer grid $Z^L$, a recursion relation for N(L, K) is as follows:

$$N(L,0)=1(L\geq 0),\ N(0,K)=0(K\geq 1)$$

$$N(L,K)=N(L-1,K)+N(L-1,K-1)+N(L,K-1)(L\geq 1,K\geq 1)$$

For the integer grid point $Y=(y_1, y_2, \ldots, y_L)\in Z^L$ on the pyramid surface with a energy radius of K, it is identified by a certain number b in [0, 1, . . . , N(L,K)−1], and b is referred to as the label of the grid point. The step for solving the label b is as follows.

In step 1.1, making b=0, i=1, k=K, l=L, N(m,n), (m<=L, n<=K) is calculated according to the above recursion formula. Define:

$$\mathrm{sgn}(x) = \begin{cases} 1 & x > 0 \\ 0 & x = 0 \\ -1 & x < 0 \end{cases}$$

In step 1.2, if $y_i = 0$, then $b = b + 0$;

if $|y_i| = 1$, then $b = b + N(l-1, k) + \left[\frac{1 - \mathrm{sgn}(y_i)}{2}\right] N(l-1, k-1)$;

if $|y_i| > 1$, then, $$b = b + N(l-1, k) + 2\sum_{j=1}^{|y_i|-1} N(l-1, k-j) + \left[\frac{1 - \mathrm{sgn}(y_i)}{2}\right] N(l-1, k-|y_i|)$$

In step 1.3, k=k−|$y_i$|, l=l−1, i=i+1, and if k=0 at the time, then searching is stopped, and b is the label of Y; otherwise, the step 1.2 is continued.

In step 2, the grid points on all pyramid surfaces are jointly labeled.

The labels of each grid point in all pyramid surfaces is calculated according to the number of the grid points of various pyramid surfaces and the label of each grid point on respective pyramid surface:

$$\mathrm{index_b}(j, m) = b(j, m) + \sum_{kk=0}^{K-2} N(8, kk) \tag{23}$$

wherein, kk is an even number. At the time, index_b(j,m) is an index of $D_8$ grid point $\tilde{Y}_j^m$ in the codebook, that is, the index of $m^{th}$ 8-dimensional vector in coding sub-band j.

e, steps a~d are repeated, until various 8-dimensional vectors of all the coding sub-bands in which the coded bits are larger than 0 complete the index generation.

f, the vector quantization index index_b(j,k) of each 8-dimensional vector in each coding sub-band is obtained according to the pyramid lattice vector quantization method, wherein, k represents $k^{th}$ 8-dimensional vector of the coding sub-band j, and the Huffman coding is performed on the quantization index index_b(j,k) in the following several conditions.

1) In all coding sub-bands in which the number of bits allocated to the single frequency-domain coefficient is larger than 1 and less than 5 except for 2, each 4 bits in the natural binary code of each vector quantization index are formed into one group and are performed with the Huffman coding.

2) In all coding sub-bands in which the number of bits allocated to the single frequency-domain coefficient is 2, the pyramid lattice vector quantization index of each 8-dimensional vector is coded using 15 bits. In the 15 bits, the Huffman coding is performed on 3 groups of 4 bits and 1 group of 3 bits respectively. Therefore, in all coding sub-bands in which the number of bits allocated to the single frequency-domain coefficient is 2, 1 bit is saved for the coding of each 8-dimensional vector.

3) When the number of bits allocated to the single frequency-domain coefficient of the coding sub-band is 1, if the quantization index is less than 127, 7 bits are used to code the quantization index, and the 7 bits are divided into 1 group of 3 bits and 1 group of 4 bits, and the Huffman coding is performed on the two groups respectively; if the quantization index is equal to 127, a value of its natural binary code is "1111 1110", and the previous seven "1"s are divided into 1 group of 3 bits and 1 group of 4 bits, and the Huffman coding is performed on the two groups respectively; and if the quantization index is equal to 128, a value of its natural binary code is "1111 1111", and the previous seven "1"s are divided into 1 group of 3 bits and 1 group of 4 bits, and the Huffman coding is performed on the two groups respectively.

The method of performing the Huffman coding on the quantization index can be described by the following pseudo-codes:

```
in all the coding sub-bands of region_bit(j) =1.5 and 2<region_bit(j)<5
{
n is within the range of [0, region_bit(j)×8/4 − 1], is increased by the step length of 1, and
the following cycle is performed:
{
index_b(j,k) is shifted to right by 4*n bits;
calculate low 4 bits tmp of index_b(j,k), that is, tmp = and(index_b(j,k), 15)
calculate the codeword of the tmp in the codebook and the number of consumed bits;
plvq_codebook(j,k) = plvq_code(tmp+1);
plvq_count(j,k) = plvq_bit_count(tmp+1);
wherein, plvq_codebook(j,k) and plvq_count(j,k) are the codeword and the number of
consumed bits in the Huffman coding codebook of k^th 8-dimensional vector of j sub-band
respectively; and plvq_bit_count and plvq_code are searched according to tale 6.
The total number of the consumed bits after using the Huffman coding is updated:
bit_used_huff_all = bit_used_huff_all + plvq_bit_count(tmp+1);
}
}
in the coding sub-band of region_bit(j) =2,
{
n is within the range of [0, region_bit(j)×8/4−2], is increased by the step length of 1, and
the following cycle is performed:
{
index_b(j,k) is shifted to right by 4*n bits;
calculate low 4 bits tmp of index_b(j,k), that is, tmp = and(index_b(j,k), 15)
calculate the codeword of the tmp in the codebook and the bit consumption thereof;
plvq_count(j,k) = plvq_bit_count (tmp+1);
plvq_codebook(j,k) = plvq_code (tmp+1);
wherein, plvq_count(j,k) and plvq_codebook(j,k) are the number of Huffman bit
consumption and the codeword of k^th 8-dimensional vector of j sub-band respectively; and
```

-continued plvq__bit__count and plvq__code are searched according to tale 6.

The total number of the consumed bits after using the Huffman coding is updated:

bit__used__huff__all = bit__used__huff__all + plvq__bit__count(tmp+1);

}

{

One condition of 3 bits is required to be processed hereinafter:

after index__b(j,k) is shifted to right by [region__bit(j)×8/4−2]*4 bits;

calculate low 3 bits tmp of index__b(j,k), that is, tmp = and(index__b(j,k), 7)

calculate the codeword of the tmp in the codebook and the bit consumption thereof;

plvq__count(j,k) = plvq__bit__count __r2__3(tmp+1);

plvq__codebook(j,k) = plvq__code __r2__3(tmp+1);

wherein, plvq__count(j,k) and plvq__codebook(j,k) are the number of Huffman bit consumption and the codeword of $k^{th}$ 8-dimensional vector of j sub-band respectively; and plvq__bit__count__r2__3 and plvq__code__r2__3 are searched according to tale 7.

The total number of the consumed bits after using the Huffman coding is updated:

bit__used__huff__all = bit__used__huff__all + plvq__bit__count(tmp+1);

}

} in the coding sub-band of region__bit(j) =1

{ if index__b(j,k)<127

{

{ calculate low 4 bits tmp of index__b(j,k), that is, tmp = and(index__b(j,k), 15)

calculate the codeword of the tmp in the codebook and the bit consumption thereof;

plvq__count(j,k) = plvq__bit__count __r1__4(tmp+1);

plvq__codebook(j,k) = plvq__code __r1__4(tmp+1);

wherein, plvq__count(j,k) and plvq__codebook(j,k) are the number of the Huffman bit consumption and the codeword of $k^{th}$ 8-dimensional vector of j sub-band respectively; and plvq__bit__count__r1__4 and plvq__code__r1__4 are searched according to tale 8.

The total number of the bit consumption after using the Huffman coding is updated:

bit__used__huff__all = bit__used__huff__all + plvq__bit__count(tmp+1);

}

{

One condition of 3 bits is required to be processed hereinafter:

index__b(j,k) is shifted to right by 4 bits;

calculate low 3 bits tmp of index__b(j,k), that is, tmp = and(index__b(j,k), 7)

calculate the codeword of the tmp in the codebook and the bit consumption thereof:

plvq__count(j,k) = plvq__bit__count __r1__3(tmp+1);

plvq__codebook(j,k) = plvq__code __r1__3(tmp+1);

wherein, plvq__count(j,k) and plvq__codebook(j,k) are the Huffman bit consumption and the codeword of $k^{th}$ 8-dimensional vector of j sub-band respectively; and codebooks plvq__bit__count__r1__3 and plvq__code__r1__3 are searched according to tale 9.

The total number of the consumed bits after using the Huffman coding is updated:

bit__used__huff__all = bit__used__huff__all + plvq__bit__count(tmp+1);

}

} if index__b(j,k)=127

{ a binary value thereof is "1111 1110"

the Huffman code tables of Table 9 and Table 8 are searched respectively for the former three "1" and the later four "1", the calculation method is the same as that in the previous condition of index__b(j,k)<127.

The total number of the consumed bit after using the Huffman coding is updated: a total of 8 bits are needed.

} if index__b(j,k)=128

{ a binary value thereof is "1111 1111"

the Huffman code tables of Table 7 and Table 6 are searched respectively for the former three "1" and the later four "1", and the calculation method is the same as that in the previous condition of index__b(j,k)<127.

The total number of the consumed bit after using the Huffman coding is updated: a total of 8 bits are needed.

}

}

Therefore, in all coding sub-bands in which the number of bits allocated to the single frequency-domain coefficient is 1, 1 bit is saved for the coding of each 8-dimensional vector when index_b(j,k)<127.

TABLE 6

Pyramid vector quantization Huffman code table

| Tmp | Plvq_bit_count | plvq_code |
|---|---|---|
| 0 | 2 | 0 |
| 1 | 4 | 6 |
| 2 | 4 | 1 |
| 3 | 4 | 5 |
| 4 | 4 | 3 |
| 5 | 4 | 7 |
| 6 | 4 | 13 |
| 7 | 4 | 10 |
| 8 | 4 | 11 |
| 9 | 5 | 30 |
| 10 | 5 | 25 |
| 11 | 5 | 18 |
| 12 | 5 | 9 |
| 13 | 5 | 14 |
| 14 | 5 | 2 |
| 15 | 4 | 15 |

TABLE 7

Pyramid vector quantization Huffman code table

| Tmp | Plvq_bit_count_r2_3 | plvq_code_r2_3 |
|---|---|---|
| 0 | 1 | 0 |
| 1 | 4 | 1 |
| 2 | 4 | 15 |
| 3 | 5 | 25 |
| 4 | 3 | 3 |
| 5 | 3 | 5 |
| 6 | 4 | 7 |
| 7 | 5 | 9 |

TABLE 8

Pyramid vector quantization Huffman code table

| Tmp | Plvq_bit_count_r1_4 | plvq_code_r1_4 |
|---|---|---|
| 0 | 3 | 1 |
| 1 | 5 | 13 |
| 2 | 5 | 29 |
| 3 | 4 | 14 |
| 4 | 4 | 3 |
| 5 | 4 | 6 |
| 6 | 4 | 1 |
| 7 | 4 | 0 |
| 8 | 4 | 8 |
| 9 | 4 | 12 |
| 10 | 4 | 4 |
| 11 | 4 | 10 |
| 12 | 4 | 9 |
| 13 | 4 | 5 |
| 14 | 4 | 11 |
| 15 | 4 | 2 |

TABLE 9

Pyramid vector quantization Huffman code table

| Tmp | Plvq_bit_count_r1_3 | plvq_code_r1_3 |
|---|---|---|
| 0 | 2 | 1 |
| 1 | 3 | 0 |

TABLE 9-continued

Pyramid vector quantization Huffman code table

| Tmp | Plvq_bit_count_r1_3 | plvq_code_r1_3 |
|---|---|---|
| 2 | 3 | 2 |
| 3 | 4 | 7 |
| 4 | 4 | 15 |
| 5 | 3 | 6 |
| 6 | 3 | 4 |
| 7 | 3 | 3 |

g: it is judged whether the Huffman coding saves bits.

A set of all the low-bit coding sub-bands is recorded as C, and the bits saved by all the coding sub-bands, in which the number of bits allocated to the single frequency-domain coefficient is 1 or 2 as described in 2) and 3) in the above step f, are calculated, and are recorded as the number of absolutely saved bits bit_saved_r1_r2_all_core, and the total number of bits bit_used_huff_all consumed after the Huffman coding is performed on the quantized vector indexes of the 8-dimensional vectors belonging to all the coding sub-bands in C are calculated; bit_used_huff_all is compared with the total number bit_used_nohuff_all of the bits consumbed by the natural coding, and if bit_used_huff_all<bit_used_nohuff_all, the quantized vector indexes after the Huffman coding are transmitted, and meanwhile, the Huffman coding flag Flag_huff_PLVQ_core is set as 1; otherwise, the natural coding is directly performed on the quantized vector indexes, and the Huffman coding flag Flag_huff_PLVQ_core is set as 0.

The above bit_used_nohuff_all is equal to a difference by the total number sum(bit_band_used(j), j∈C) of the number of bits allocated to all the coding sub-bands in C minus bit_saved_r1_r2_all.

h: the bit allocation number is corrected.

If the Huffman coding flag Flag_huff_PLVQ_core is 0, the bit allocation of the coding sub-bands is corrected by using the number of initial allocation remaining bits remain_bits_core and the number of absolutely saved bits bit_saved_r1_r2_all_core. If the Huffman coding flag Flag_huff_PLVQ_core is 1, the bit allocation of the coding sub-bands is corrected by using the number of initial allocation remaining bits remain_bits_core, the number of absolutely saved bits bit_saved_r1_r2_all_core and the bits saved by the Huffman coding.

The spherical lattice vector quantization and coding method will be illustrated hereinafter.

The high-bit coding sub-bands are quantized by using the spherical lattice vector quantization method, and at the time, the number of bits allocated to sub-band j meets 5<=region_bit(j)<=9.

Herein, 8-dimensional grid vector quantization based on $D_8$ grid is also used.

a, the energy of the normalized $m^{th}$ vector $Y_j^m$ to be quantized of the coding sub-band is regularized according to the number of bits region_bit(j) allocated to a single frequency-domain coefficient in the coding sub-band j as follows:

$$\hat{Y}_j^m=\beta(Y_j^m-a) \tag{24}$$

wherein, $a=(2^{-6}, 2^{-6}, 2^{-6}, 2^{-6}, 2^{-6}, 2^{-6}, 2^{-6}, 2^{-6})$, $$\beta=\frac{2^{region_bit(j)}}{\text{scale(region_bit}(j))},$$

while scale(region_bit(j)) represents an energy scaling factor when the bit allocation number of the single frequency-domain coefficient in the coding sub-band is region_bit(j), and the corresponding relationship thereof can be searched according to Table 10.

TABLE 10

Corresponding relationship between bit allocation number of the spherical grid vector quantization and energy scaling factor

| bit allocation number region_bit | energy scaling factor scale |
|---|---|
| 5 | 6 |
| 6 | 6.2 |
| 7 | 6.5 |
| 8 | 6.2 |
| 9 | 6.6 |

b, index vectors of $D_8$ grid points are generated.

The $m^{th}$ vector $\hat{Y}_j^m$ to be quantized after being performed with energy scaling in the coding sub-band j is mapped into the grid point $\tilde{Y}_j^m$ of $D_8$:

$$\tilde{Y}_j^m = f_{D_8} \tag{25}$$

It is judged whether $f_{D_8}(\tilde{Y}_j^m/2^{region_bit(j)})$ is a zero vector, i.e., whether various components thereof are all zeros, and if $f_{D_8}(\tilde{Y}_j^m/2^{region_bit(j)})$ is a zero vector, it is referred to as meeting the zero vector condition; otherwise, it is referred to as not meeting the zero vector condition.

If the zero vector condition is met, the index vector can be obtained by the following index vector generation equation:

$$k = (\tilde{Y}_j^m G^{-1}) \bmod 2^{region_bit(j)} \tag{26}$$

The index vector k of the $D_8$ grid point $\tilde{Y}_j^m$ is output at the time, wherein, G is a generation matrix of the $D_8$ grid point, and the form is as follows:

$$G = \begin{bmatrix} 2 & 0 & 0 & 0 & 0 & 0 & 0 & 0 \\ 1 & 1 & 0 & 0 & 0 & 0 & 0 & 0 \\ 1 & 0 & 1 & 0 & 0 & 0 & 0 & 0 \\ 1 & 0 & 0 & 1 & 0 & 0 & 0 & 0 \\ 1 & 0 & 0 & 0 & 1 & 0 & 0 & 0 \\ 1 & 0 & 0 & 0 & 0 & 1 & 0 & 0 \\ 1 & 0 & 0 & 0 & 0 & 0 & 1 & 0 \\ 1 & 0 & 0 & 0 & 0 & 0 & 0 & 1 \end{bmatrix};$$

If the zero vector condition is not met, the value of the vector $\hat{Y}_j^m$ is divided by 2, until the zero vector condition $f_{D_8}(\tilde{Y}_j^m/2^{region_bit(j)})$ is satisfied; and the value of small multiple of $\hat{Y}_j^m$ itself is backed up as w, then the decreased vector $\hat{Y}_j^m$ adds the backed up value of small multiple w, and then is quantized to the $D_8$ grid point, to judge whether the zero vector condition is met; if the zero vector condition is not met, an index vector k of the $D_8$ grid point which proximally meets the zero vector condition is obtained according to the index vector calculation equation, otherwise, the vector $\hat{Y}_j^m$ continues to add the backed up value of small multiple w, and then quantize to the $D_8$ grid point, until the zero vector condition is met; and finally, the index vector k of the $D_8$ grid point which proximally meets the zero vector condition is obtained according to the index vector calculation equation; and the index vector k of the $D_8$ grid point $\tilde{Y}_j^m$ is output. Such process can also be described by the following pseudo-codes:

```
temp _D = f_D8 (Ŷ_j^m / 2^region_bit(j))
Ybak = Ŷ_j^m
Dbak = temp _D
While temp _D ≠ 0
{
  Ŷ_j^m = Ŷ_j^m /2
  Ŷ_j^m = f_D8 (Ŷ_j^m)
  temp _D = f_D8 (Ŷ_j^m / 2^region_bit(j))
}
    w = Ŷ_j^m /16
  Ybak = Ŷ_j^m
  Dbak = temp _D
While temp _D = 0
{
      Ybak = Ŷ_j^m
    Dbak = temp _D
  Ŷ_j^m = Ŷ_j^m + w
  Ŷ_j^m = f_D8 (Ŷ_j^m)
    temp _D = f_D8 (Ŷ_j^m / 2^region_bit(j))
}
  Ŷ_j^m = Ybak
  k = (Ŷ_j^m G^-1) mod 2^region_bit(j)
```

c, the vector quantization indexes of the high-bit coding sub-bands are coded, and at the time, the number of bits allocated to the sub-band j meets 5<=region_bit(j)<=9.

According to the spherical lattice vector quantization method, the 8-dimensional vector in the coding sub-bands in which the bit allocation number is 5 to 9 are quantized to obtain the vector index k={k1, k2, k3, k4, k5, k6, k7, k8}, and the natural coding is performed on various components of the index vector k according to the number of bits allocated to the single frequency-domain coefficient, to obtain the coded bits of the vector.

Figure 3:
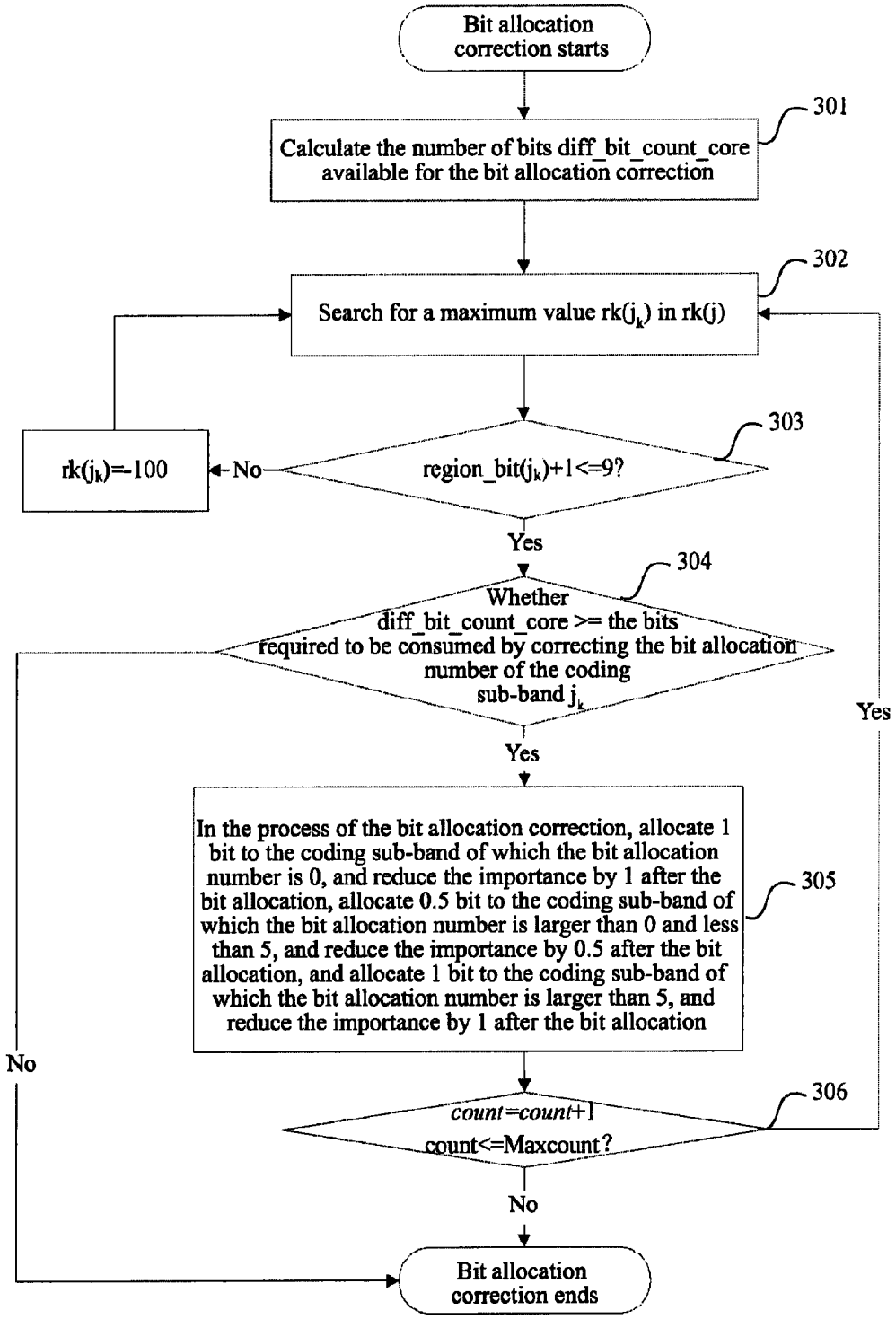
FIG. 3 is a flow chart of a method for performing bit allocation correction after vector quantization according to the present invention.

As shown in FIG. 3, the process of the bit allocation correction specifically comprises the following steps.

In 301, the number of bits diff_bit_count_core available for the bit allocation correction is calculated. If the Huffman coding flag Flag_huff_PLVQ_core is 0, then diff_bit_count_core=remain_bits_core+bit_saved_r1_r2_all_core;

if the Huffman coding flag Flag_huff_PLVQ_core is 1, then diff_bit_count_core=remain_bits_core+bit_saved_r1_r2_all_core+(bit_used_nohuff_all-bit_used_huff_all).

Making count=0:

in 302, if diff_bit_count_core is larger than 0, then a maximum value $rk(j_k)$ is searched in all rk(j)(j=0, . . . , L_core−1), which is represented by an equation as:

$$j_k = \underset{j=0,\ldots,L-1}{\operatorname{argmax}} [rk(j)] \tag{27}$$

In 303, it is judged whether region_bit($j_k$)+1 is less than or equal to 9, and if region_bit($j_k$)+1 is less than or equal to 9, the next step is performed; otherwise, the importance of the coding sub-band corresponding to $j_k$ is adjusted to be the lowest (for example, making $rk(j_k)=-100$), which indicates that there is no need to correct the bit allocation number of that coding sub-band, and it is jumped to step 302.

In 304, it is judged whether diff_bit_count_core is larger than or equal to the bits required to be consumed by correcting the bit allocation number of the coding sub-band $j_k$ (if Flag_huff_PLVQ_core is 0, it is calculated according to the natural coding; and if Flag_huff_PLVQ_core is 1, it is calculated according to the Huffman coding), and if yes, step 305 is performed, the bit allocation number region_bit($j_k$) of the coding sub-band $j_k$ is corrected, the value of the importance $rk(j_k)$ of the sub-band is reduced, the vector quantization and the natural coding or Huffman coding is performed again on the coding sub-band $j_k$, and finally the value of diff_bit_count_core is updated; otherwise, the process of the bit allocation correction ends.

In 305, in the process of the bit allocation correction, 1 bit is allocated to the coding sub-band of which the bit allocation number is 0, and the importance is reduced by 1 after the bit allocation, 0.5 bit is allocated to the coding sub-band of which the bit allocation number is larger than 0 and less than 5, and the importance is reduced by 0.5 after the bit allocation, and 1 bit is allocated to the coding sub-band of which the bit allocation number is larger than 5, and the importance is reduced by 1 after the bit allocation.

In 306, making count=count+1, it is adjusted whether count is less than or equal to Maxcount, and if count is less than or equal to Maxcount, it is jumped to step 302; otherwise, the process of the bit allocation correction ends.

The above Maxcount is an upper limit of the number of times of loop iteration, which is determined according to the coded bit stream and the sampling rate. In the present embodiment, if the Huffman coding flag Flag_huff_PLVQ is 0, then Maxcount=7 is used; and if the Huffman coding flag Flag_huff_PLVQ is 1, then Maxcount=31 is used.

In 108, the inverse quantization is performed on the above-described frequency-domain coefficients in the core layer which are performed with the vector quantization, and a difference calculation is performed between the inversely quantized frequency-domain coefficients and the original frequency-domain coefficients obtained after being performed with the time-frequency transform, to obtain core layer residual signals, and extended layer coding signals are constituted by using the core layer residual signals and the extended layer frequency-domain coefficients.

It can be understood that, the step of constituting the extended layer coding signals (step 108) can also be performed after the bit allocations of the extended layer coding signals (step 110) are complete.

In 109, sub-band dividing is performed on the core layer residual signals which is same as that on the frequency-domain coefficients, and the amplitude envelope quantization indexes of the coding sub-bands of the core layer residual signals are calculated according to the amplitude envelope quantization indexes of the core layer coding sub-bands and the bit allocation numbers of the core layer (i.e., various region_bit(j), j=0, . . . , L_core−1).

The present step can be implemented by the following sub-steps.

In 109*a*, a correction value statistic table of the amplitude envelope quantization indexes of the core layer residual signals is searched according to the number of bits region_bit(j), j=0, . . . , L_core−1 allocated to the single frequency-domain coefficient in the core layer coding sub-bands, to obtain the correction values diff(region_bit(j)), j=0, . . . , L_core−1 of the amplitude envelope quantization indexes of the core layer residual signals;

wherein, region_bit(j)=1, 1.5, 2, 2.5, 3, 3.5, 4, 4.5, 5, 6, 7, 8, j=0, . . . , L_core−1, while the correction values of the amplitude envelope quantization indexes can be set according to the following rule:

diff(region_bit(j))≥0; and when region_bit(j)≥0, diff(region_bit(j)) does not decrease as the value of region_bit(j) increases.

In order to obtain better effect of the coding and decoding, a statistic can be performed on the amplitude envelope quantization indexes of the sub-bands which are calculated under various bit allocation numbers (region_bit(j)) and the amplitude envelope quantization indexes of the sub-bands which are calculated from the residual signals directly, to obtain the correction value statistical table of the amplitude envelope quantization indexes with the highest probability, as shown in Table 11:

TABLE 11

Correction value statistical table of amplitude envelope quantization indexes

| region_bit | diff |
|---|---|
| 1 | 1 |
| 1.5 | 2 |
| 2 | 3 |
| 2.5 | 4 |
| 3 | 5 |
| 3.5 | 5 |
| 4 | 6 |
| 4.5 | 7 |
| 5 | 7 |
| 6 | 9 |
| 7 | 10 |
| 8 | 12 |

In 109*b*, the amplitude envelope quantization index of the $j^{th}$ sub-band of the core layer residual signal is calculated according to the amplitude envelope quantization index of the coding sub-band j in the core layer and the correction value of the quantization index in Table 8:

$$Th'_q(j)=Th_q(j)-\text{diff}(\text{region_bit}(j)),\ j=0,\ldots,L_\text{core}-1,$$

wherein, $Th_q$ (j) is the amplitude envelope quantization index of the coding sub-band j in the core layer.

It should be noted that, when the bit allocation number of a certain coding sub-band in the core layer is 0, there is no need to correct the amplitude envelope of the coding sub-band of the core layer residual signal, and at the time, the amplitude envelope value of the sub-band of the core layer residual signal is the same as the amplitude envelope value of the core layer coding sub-band.

In addition, when a bit allocation number of a certain coding sub-band in the core layer is that region_bit(j)=9, the quantized amplitude envelope value of the $j^{th}$ coding sub-band of the core layer residual signal is set as zero.

In 110, the bit allocation is performed on the coding sub-bands of the extended layer coding signals in the extended layer.

The sub-band dividing of the extended layer is determined by Table 1 or Table 2. The coding signals in the sub-bands 0, . . . , L_core−1 are the core layer residual signals, and the coding signals in L_core, . . . , L−1 are the frequency-domain coefficients in the extended layer coding sub-bands. The sub-bands 0 to L−1 are also referred to as the coding sub-bands of the extended layer coding signals.

According to the calculated amplitude envelope quantization indexes of the core layer residual signals, the amplitude envelope quantization indexes of the extended layer coding sub-bands and the number of bits available for the extended layer, initial values of importance of the coding sub-bands of the extended layer coding signals are calculated within the whole frequency range of the extended layer by using the bit allocation solution which is the same as that of the core layer, and the bit allocation is performed on the coding sub-bands of the extended layer coding signals.

In the present embodiment, the frequency range of the extended layer is 0~13.6 kHz. The total bit rate of the audio stream is 64 kbps, the bit rate of the core layer is 32 kbps, and then the maximum bit rate of the extended layer is 64 kbps. The total available number of bits in the extended layer is calculated according to the bit rate of the core layer and the maximum bit rate of the extended layer, and then the bit allocation is performed, until the bits are completely consumed.

In 111, the normalization, vector quantization and coding are performed on the extended layer coding signals according to the amplitude envelope quantization indexes of the coding sub-bands of the extended layer coding signals and the corresponding bit allocation numbers, to obtain coded bits of the coding signals. Wherein, the vector constitution, the vector quantization method and the coding method of the coding signals in the extended layer are the same as those of the frequency-domain coefficients in the core layer respectively.

In 112, the hierarchical coded bit stream is constituted, and bit rate layers are constituted according to the value of the bit rate.

Figures 4, 5:
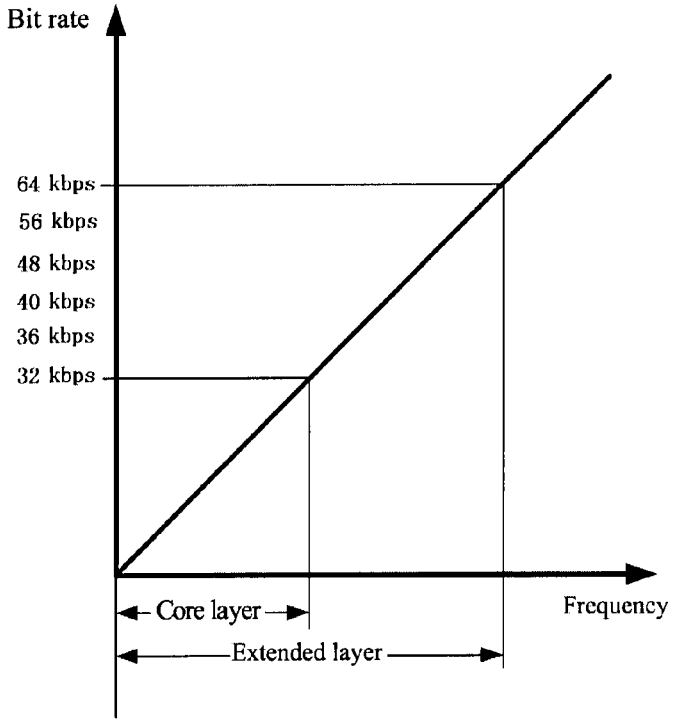
FIG. 4 is a schematic diagram of a hierarchical coded bit stream according to the present invention.
FIG. 5 is a schematic diagram of a relationship between a hierarchy in terms of a frequency range and a hierarchy in terms of a bit rate according to the present invention.

As shown in FIG. 4, the hierarchical coded bit stream is constituted by using the following mode: firstly, writing the side information of the core layer into the bit stream multiplexer MUX according to the following order: Flag_transient, Flag_huff_rms_core, Flag_huff_PLVQ_core and count_core, and then writing the amplitude envelope coded bits of the core layer coding sub-bands into the MUX, and then writing the coded bits of the core layer frequency-domain coefficients into the MUX; then writing the side information of the extended layer into the MUX according to the following order: Huffman coding flag bit Flag_huff_rms_ext of the amplitude envelopes of the extended layer coding sub-bands, Huffman coding flag bit Flag_huff_PLVQ_ext of the frequency-domain coefficients, and the number of times of iteration count_ext of the bit allocation correction, then writing the amplitude envelope coded bits of the extended layer coding sub-bands (L_core, . . . , L−1) into the MUX, and then writing the coded bits of the extended layer coding signals into the MUX; and finally the hierarchical bit stream which are written according to the above order is transmitted to a decoding end;

wherein, the order of writing the coded bits of the extended layer coding signals is arranged according to the initial values of the importance of the coding sub-bands of the extended layer coding signals. That is, the coded bits of the coding sub-bands of the extended layer coding signals with a large initial value of the importance are preferentially written into the bit stream, and for the coding sub-bands with the same importance, the low-frequency coding sub-band is preferential.

The amplitude envelopes of the residual signals in the extended layer are calculated according to the amplitude envelopes of the core layer coding sub-bands and the bit allocation numbers, therefore there is no need to transmit to the decoding end. Thus, not only the coding accuracy of the core layer bandwidth can be increased, but also there is no need to add bits to transmit the amplitude envelope values of the residual signals.

After rounding the bits which are unnecessary at the back of the bit stream multiplexer according to the bit rate required to be transmitted, the number of bits meeting the requirement on the bit rate is transmitted to the decoding end. That is, the unnecessary bits are rounded in an order of the importance of the coding sub-bands from small to large.

In the present embodiment, the coding frequency range is 0~13.6 kHz, the maximum bit rate is 64 kpbs, and the hierarchical method according to the bit rate is as follows:

the frequency-domain coefficients within the coding frequency range of 0~7 kHz are divided into a core layer, a maximum bit rate corresponding to the core layer is 32 kbps, and the core layer is recorded as L0 layer; and, the coding frequency range of the extended layer is 0~13.6 kHz, the maximum bit rate thereof is 64 kbps, and the extended layer is recorded as $L_1$_5 layer; and before being transmitted to the decoding end, according to the number of bits which are rounded, the bit rates can be divided into a $L_1$_1 layer corresponding to 36 kbps, a $L_1$_2 layer corresponding to 40 kbps, a $L_1$_3 layer corresponding to 48 kbps, a $L_1$_4 layer corresponding to 56 kbps and a $L_1$_5 layer corresponding to 64 kbps.

FIG. 5 illustrates a relationship between a hierarchy according to a frequency range and a hierarchy according to a bit rate.

Figure 6:
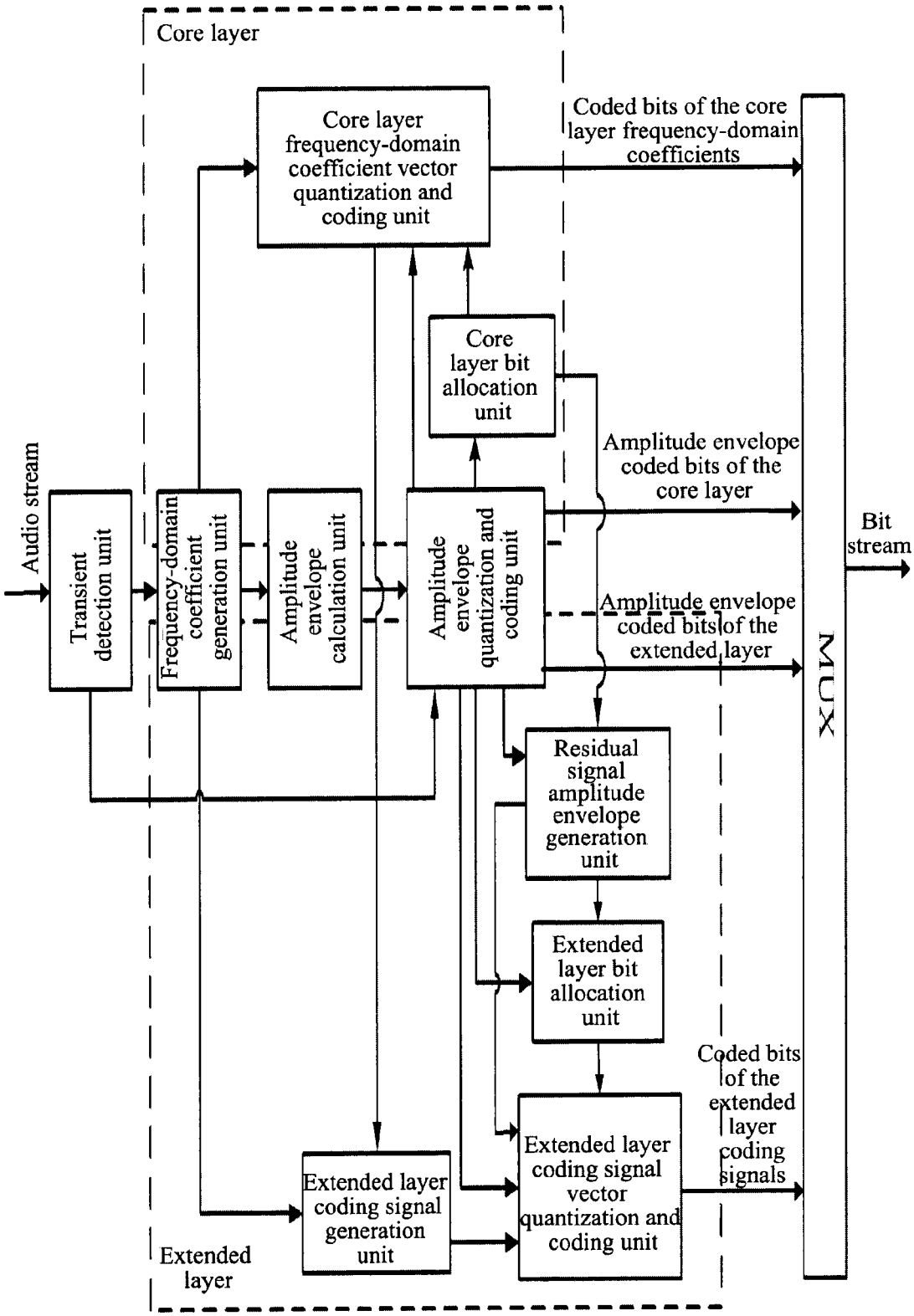
FIG. 6 is a structural diagram of a hierarchical audio coding system according to the present invention.

FIG. 6 is a structural diagram of a hierarchical audio coding system according to the present invention. As shown in FIG. 6, the system comprises: a transient detection unit, a frequency-domain coefficient generation unit, an amplitude envelope calculation unit, an amplitude envelope quantization and coding unit, a core layer bit allocation unit, a core layer frequency-domain coefficient vector quantization and coding unit, an extended layer coding signal generation unit, a residual signal amplitude envelope generation unit, an extended layer bit allocation unit, an extended layer coding signal vector quantization and coding unit, and a bit stream multiplexer; wherein, the transient detection unit is configured to perform a transient detection on an audio signal of a current frame;

the frequency-domain coefficient generation unit is connected with the transient detection unit, and is configured to: when the transient detection is to be a steady-state signal, perform a time-frequency transform on an audio signal to obtain total frequency-domain coefficients; when the transient detection is to be a transient signal, divide the audio signal into M sub-frames, perform the time-frequency transform on each sub-frame, constitute total frequency-domain coefficients of the current frame by the M groups of frequency-domain coefficients obtained by transformation, rearrange the total frequency-domain coefficients so that their corresponding coding sub-bands are aligned from low frequencies to high frequencies, wherein, the total frequency-domain coefficients comprise core layer frequency-domain coefficients and extended layer frequency-domain coefficients, the coding sub-bands comprise core layer coding sub-bands and extended layer coding sub-bands, the core layer frequency-domain coefficients constitute several core layer coding sub-bands, and the extended layer frequency-domain coefficients constitute several extended layer coding sub-bands;

the amplitude envelope calculation unit is connected with the frequency-domain coefficient generation unit, and is configured to calculate amplitude envelope values of the core layer coding sub-bands and the extended layer coding sub-bands;

the amplitude envelope quantization and coding unit is connected with the amplitude envelope calculation unit and the transient detection unit, and is configured to quantize and code the amplitude envelope values of the core layer coding sub-bands and the extended layer coding sub-bands, to obtain amplitude envelope quantization indexes and amplitude envelope coded bits of the core layer coding sub-bands and the extended layer coding sub-bands; wherein, if the signal is the steady-state signal, the amplitude envelope values of the core layer coding sub-bands and the extended layer coding sub-bands are jointly quantized, and if the signal is the transient signal, the amplitude envelope values of the core layer coding sub-bands and the extended layer coding sub-bands are separately quantized respectively, and the amplitude envelope quantization indexes of the core layer coding sub-bands and the amplitude envelope quantization indexes of the extended layer coding sub-bands are rearranged respectively;

the core layer bit allocation unit is connected with the amplitude envelope quantization and coding unit, and is configured to perform a bit allocation on the core layer coding sub-bands according to the amplitude envelope quantization indexes of the core layer coding sub-bands, to obtain bit allocation numbers of the core layer coding sub-bands;

the core layer frequency-domain coefficient vector quantization and coding unit is connected with the frequency-domain coefficient generation unit, the amplitude envelope quantization and coding unit and the core layer bit allocation unit, and is configured to: perform normalization, vector quantization and coding on the frequency-domain coefficients of the core layer coding sub-bands by using the bit allocation numbers and a quantized amplitude envelope values of the core layer coding sub-bands reconstructed according to the amplitude envelope quantization indexes of the core layer coding sub-bands, to obtain coded bits of the core layer frequency-domain coefficients;

the extended layer coding signal generation unit is connected with the frequency-domain coefficient generation unit and the core layer frequency-domain coefficient vector quantization and coding unit, and is configured to generate residual signals, to obtain extended layer coding signals comprised of the residual signals and the extended layer frequency-domain coefficients;

the residual signal amplitude envelope generation unit is connected with the amplitude envelope quantization and coding unit and the core layer bit allocation unit, and is configured to obtain amplitude envelope quantization indexes of the core layer residual signals according to the amplitude envelope quantization indexes of the core layer coding sub-bands and the bit allocation numbers of the corresponding coding sub-bands;

the extended layer bit allocation unit is connected with the residual signal amplitude envelope generation unit and the amplitude envelope quantization and coding unit, and is configured to perform the bit allocation on the extended layer coding sub-bands according to the amplitude envelope quantization indexes of the core layer residual signals and the amplitude envelope quantization indexes of the extended layer coding sub-bands, to obtain the bit allocation numbers of the extended layer coding sub-bands;

the extended layer coding signal vector quantization and coding unit is connected with the amplitude envelope quantization and coding unit, the extended layer bit allocation unit, the residual signal amplitude envelope generation unit, and the extended layer coding signal generation unit, and is configured to: perform normalization, vector quantization and coding on the extended layer coding signals by using the bit allocation numbers and the quantized amplitude envelope values of the coding sub-bands of extended layer coding signals reconstructed according to the amplitude envelope quantization indexes of the coding sub-bands of the extended layer coding signals, to obtain coded bits of the extended layer coding signals;

the bit stream multiplexer is connected with the amplitude envelope quantization and coding unit, the core layer frequency-domain coefficient vector quantization and coding unit, the extended layer coding signal vector quantization and coding unit, and is configured to packet side information bits of the core layer, the amplitude envelope coded bits of the core layer coding sub-bands, the coded bits of the core layer frequency-domain coefficients, side information bits of the extended layer, the amplitude envelope coded bits of the extended layer coding sub-bands, and the coded bits of the extended layer coding signals.

The frequency domain coefficient generation unit is configured to: when obtaining the total frequency domain coefficients of the current frame, compose a 2N-point time-domain-sampled signal $\overline{x}(n)$ by a N-point time-domain-sampled signal x(n) of the current frame and a N-point time-domain-sampled signal $x_{old}(n)$ of the last frame, and then perform windowing and time-domain aliasing processing on $\overline{x}(n)$ to obtain a N-point time-domain-sampled signal $\tilde{x}(n)$; and perform a reversing processing on the time-domain signal $\tilde{x}(n)$, subsequently add a sequence of zeros at both ends of the signal respectively, divide the lengthened signal into M sub-frames which are overlapped with each other, and then perform the windowing, the time-domain aliasing processing and the time-frequency transform on the time-domain signal of each sub-frame, to obtain M groups of frequency-domain coefficients and then constitute the total frequency-domain coefficients of the current frame.

The frequency domain coefficient generation unit is further configured to: when rearranging the frequency-domain coefficients, rearrange the frequency-domain coefficients respectively so that their corresponding coding sub-bands are aligned from low frequencies to high frequencies within the core layer and within the extended layer.

The amplitude envelope quantization and coding unit rearranging the amplitude envelope quantization indexes is specifically to: rearrange the amplitude envelope quantization indexes of the coding sub-bands within the same sub-frame together so that their corresponding frequencies are aligned in an ascending or descending order, and connect them by using two coding sub-bands which represent peer-to-peer frequencies and belong to two sub-frames respectively at a sub-frame boundaries.

The bit stream multiplexer multiplexes and packets in accordance with the following bit stream format:

firstly, writing the side information bits of the core layer at the back of a frame head of the bit stream, writing the amplitude envelope coded bits of the core layer coding sub-bands into a bit stream multiplexer (MUX), and then writing the coded bits of the core layer frequency-domain coefficients into the MUX;

then, writing the side information bits of the extended layer into the MUX, then writing the amplitude envelope coded bits of the coding sub-bands of the extended layer frequency-domain coefficients into the MUX, and then writing the coded bits of the extended layer coding signals into the MUX; and transmitting the number of bits which meets the requirement on the bit rate to the decoding end according to the required bit rate.

The side information of the core layer comprises a transient detection flag bit, a Huffman coding flag bit of the amplitude envelopes of the core layer coding sub-bands, a Huffman coding flag bit of the core layer frequency-domain coefficients and a bit of the number of times of iteration of the bit allocation correction of the core layer.

The side information of the extended layer comprises a Huffman coding flag bit of an amplitude envelopes of extended layer coding sub-bands, a Huffman coding flag bit of the extended layer coding signals and a bit of the number of times of iteration of the bit allocation correction of the extended layer.

The extended layer coding signal generation unit further comprises a residual signal generation module and an extended layer coding signal combination module;

the residual signal generation module is configured to inversely quantize the quantization values of the core layer frequency-domain coefficients, and perform a difference calculation with the core layer frequency-domain coefficients, to obtain core layer residual signals; and the extended layer coding signal combination module is configured to combine the core layer residual signals and the extended layer frequency-domain coefficients in an order of frequency bands, to obtain the extended layer coding signals.

The residual signal amplitude envelope generation unit further comprises a quantization index correction value acquiring module and a residual signal amplitude envelope quantization index calculation module;

the quantization index correction value acquiring module is configured to search for a correction value statistical table of the amplitude envelope quantization indexes of the core layer residual signals according to the bit allocation numbers of the core layer coding sub-bands, to obtain correction values of the quantization indexes of the coding sub-bands of the residual signals, wherein, the correction value of the quantization index of each coding sub-band is larger than or equal to 0, and does not decrease when the bit allocation number of the corresponding core layer coding sub-band increases, and if the bit allocation number of the core layer coding sub-band is 0, the correction value of the quantization index of the core layer residual signal at that coding sub-band is 0, and if the bit allocation number of the sub-band is a defined maximum bit allocation number, the amplitude envelope value of the residual signal at the sub-band is 0; and the residual signal amplitude envelope quantization index calculation module is configured to perform a difference calculation between the amplitude envelope quantization index of the core layer coding sub-band and the correction value of the quantization index of the corresponding coding sub-band, to obtain the amplitude envelope quantization index of the coding sub-band of the core layer residual signal.

The bit stream multiplexer is further configured to write the coded bits of the extended layer coding signals into a bit stream in an order of initial values of importance of the coding sub-bands of the extended layer coding signals from large to small, and preferably write the coded bits of low frequency coding sub-bands into the bit stream for the coding sub-bands with the same importance.

The specific functions of various units (modules) in FIG. 6 are referred to the description of the process illustrated in FIG. 2 for detail.

Decoding Method and System

Figure 7:
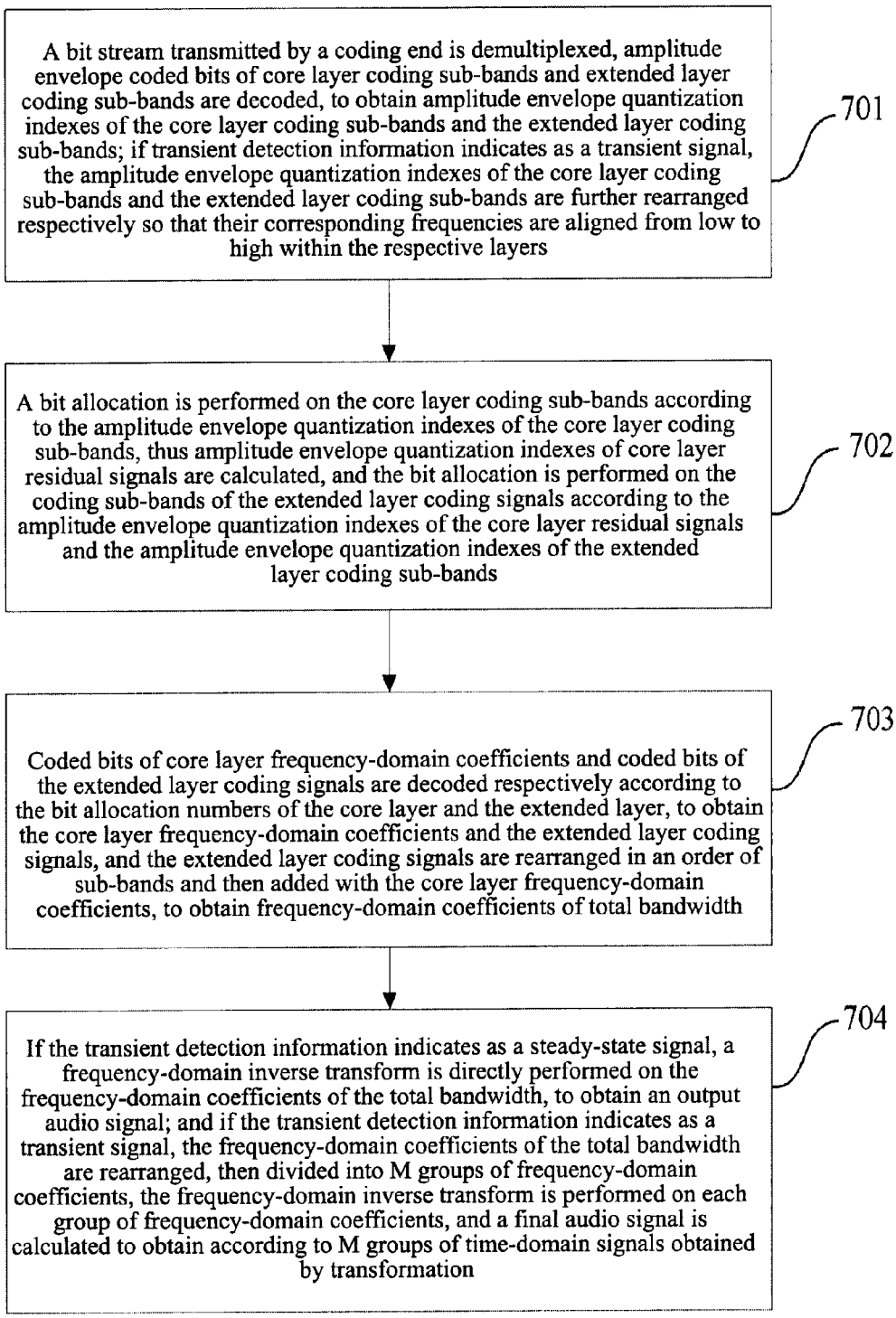
FIG. 7 is a schematic diagram of a hierarchical audio decoding method according to the present invention.

Based on the idea of the present invention, a hierarchical audio decoding method according to the present invention is shown in FIG. 7, and the decoding method comprises the following steps.

In step 701, a bit stream transmitted by a coding end is demultiplexed, amplitude envelope coded bits of core layer coding sub-bands and extended layer coding sub-bands are decoded, to obtain amplitude envelope quantization indexes of the core layer coding sub-bands and the extended layer coding sub-bands; if transient detection information indicates a transient signal, the amplitude envelope quantization indexes of the core layer coding sub-bands and the extended layer coding sub-bands are further rearranged respectively so that their corresponding frequencies are aligned from low to high within the respective layers.

In step 702, a bit allocation is performed on the core layer coding sub-bands according to the amplitude envelope quantization indexes of the core layer coding sub-bands, thus amplitude envelope quantization indexes of core layer residual signals are calculated, and the bit allocation is performed on the coding sub-bands of the extended layer coding signals according to the amplitude envelope quantization indexes of the core layer residual signals and the amplitude envelope quantization indexes of the extended layer coding sub-bands.

The method of calculating the amplitude envelope quantization indexes of the residual signal comprises: searching a correction value statistical table of the amplitude envelope quantization indexes of the core layer residual signals according to the bit allocation numbers of the core layer, to obtain corresction values of the amplitude envelope quantizaion indexes of the core layer residual signals; and performing a difference calculation between the amplitude envelope quantization indexes of the core layer coding sub-bands and the correction values of the amplitude envelope quantization indexes of the core layer residual signals of the corresponding coding sub-bands, to obtain the amplitude envelope quantization indexes of the core layer residual signals; wherein, the correction value of the amplitude envelope quantization index of the core layer residual signal of each coding sub-band is larger than or equal to 0, and does not decrease when the bit allocation number of the corresponding core layer coding sub-band increases; and when the bit allocation number of a certain core layer coding sub-band is 0, the correction value of the amplitude envelope quantization index of the core layer residual signal is 0, and when the bit allocation number of a certain core layer coding sub-band is a defined maximum bit allocation number, the amplitude envelope value of the corresponding core layer residual signal is 0.

In step 703, coded bits of core layer frequency-domain coefficients and coded bits of the extended layer coding signals are decoded respectively according to the bit allocation numbers of the core layer and the extended layer, to obtain the core layer frequency-domain coefficients and the extended layer coding signals, and the extended layer coding signals are rearranged in an order of sub-bands and then added with the core layer frequency-domain coefficients, to obtain frequency-domain coefficients of total bandwidth.

In step 704, if the transient detection information indicates a steady-state signal, an inverse time-frequency transform is directly performed on the frequency-domain coefficients of the total bandwidth, to obtain an audio signal for output; and if the transient detection information indicates a transient signal, the frequency-domain coefficients of the total bandwidth are rearranged, then divided into M groups of frequency-domain coefficients, the inverse time-frequency transform is performed on each group of frequency-domain coefficients, and a final audio signal is calculated to obtain according to M groups of time-domain signals obtained by transformation.

The coded bits of the extended layer coding signals are decoded by the following order.

In the extended layer, the order of decoding of the coded bits of the extended layer coding signals is determined according to initial values of the importance of the coding sub-bands of the corresponding extended layer coding signals; that is, the coding sub-bands of the extended layer coding signals with large importance are decoded preferentially, and if there are two coding sub-bands of the extended layer coding signals with the same importance, then the low-frequency coding sub-band is decoded preferentially, and the number of the decoded bits is calculated in the process of the decoding, and when the number of the decoded bits meets the requirement on the total number of bits, the decoding is stopped.

Figure 8:
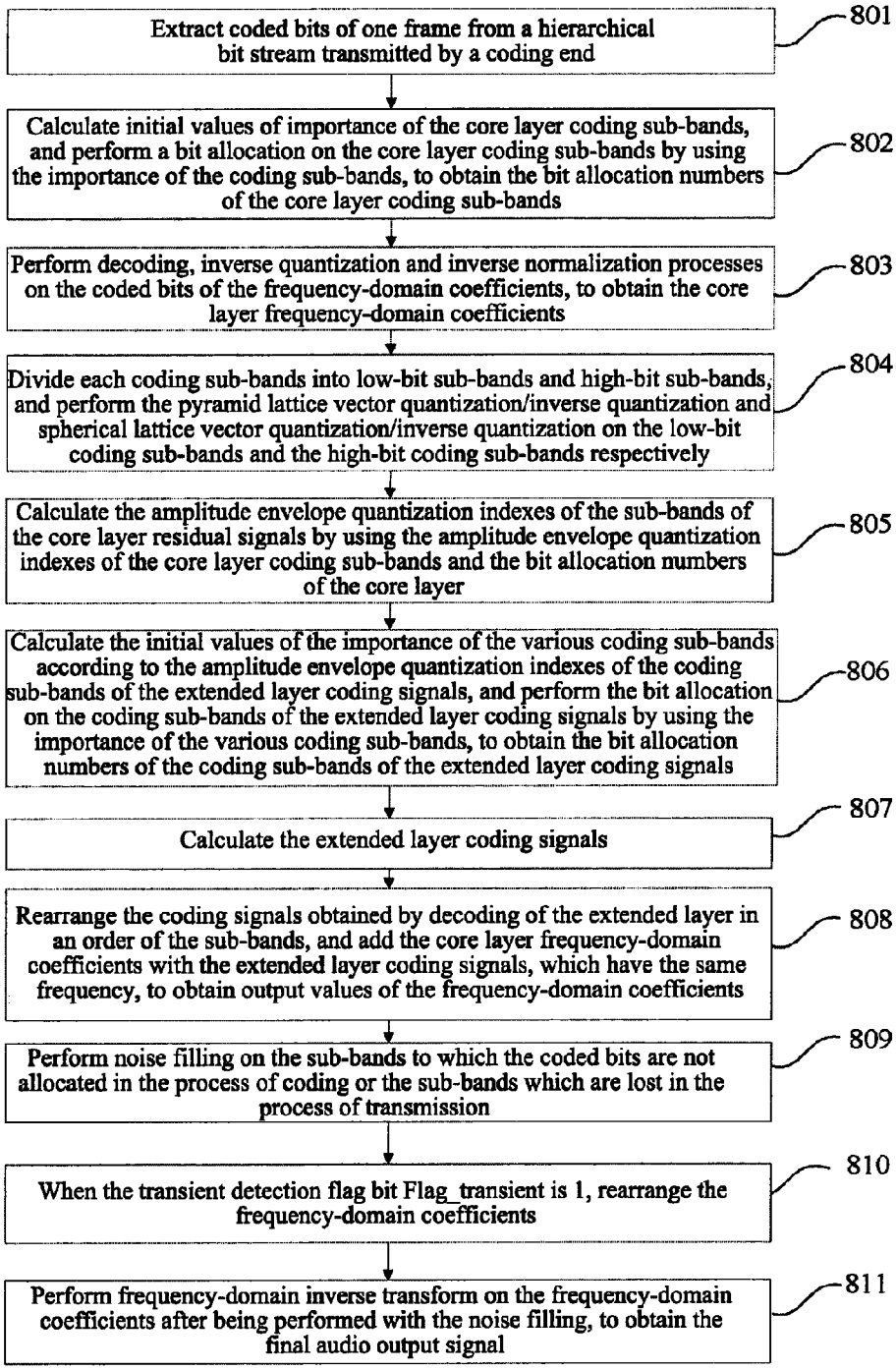
FIG. 8 is a flow chart of a hierarchical audio decoding method according to an embodiment of the present invention.

FIG. 8 is a flow chart of an embodiment of a hierarchical audio decoding method according to the present invention. As shown in FIG. 8, the method comprises the following steps.

In 801, coded bits of one frame are extracted from the hierarchical bit stream transmitted by a coding end (i.e., from a bit stream demultiplexer DeMUX).

after extracting the coded bits, the side information is firstly decoded, and then Huffman decoding or direct decoding is performed on amplitude envelope coded bits of the core layer in that frame according to a value of Flag_huff_rms_core, to obtain the amplitude envelope quantization indexes $Th_q(j)$, j=0, . . . , L_core−1 of the core layer coding sub-bands.

In 802, initial values of importance of the core layer coding sub-bands are calculated according to the amplitude envelope quantization indexes of the core layer coding sub-bands, and a bit allocation is performed on the core layer coding sub-bands by using the importance of the sub-bands, to obtain the bit allocation number of the core layer; the bit allocation method of the decoding end is the same as the bit allocation method of the coding end completely. In the process of bit allocation, the step length of the bit allocation and the step length of the importance reduction of the coding sub-bands after the bit allocation are variable.

After completing the above process of bit allocation, the bit allocation is performed again on the core layer coding sub-bands for count_core times according to a value of the number of times count_core of the bit allocation correction of the core layer at the coding end and the importance of the core layer coding sub-bands, and then the whole process of the bit allocation ends.

In the process of the bit allocation, the step length for allocating the bit to the coding sub-band of which the bit allocation number is 0 is 1 bit, and the step length of the importance reduction after the bit allocation is 1; the step length of the bit allocation is 0.5 bit when the bit is additionally allocated to the coding sub-band of which the bit allocation number is larger than 0 and less than a certain threshold, and the step length of the importance reduction after the bit allocation is also 0.5; and the step length of the bit allocation is 1 bit when the bit is additionally allocated to the coding sub-band of which the bit allocation number is larger than or equal to that threshold, and the step length of the importance reduction after the bit allocation is also 1.

In 803, decoding, inverse quantization and inverse normalization processes are performed on the coded bits of the core layer frequency-domain coefficients by using the bit allocation numbers of the core layer coding sub-bands and the quantized amplitude envelope values of the core layer coding sub-bands and according to Flag_huff_PLVQ_core, to obtain the core layer frequency-domain coefficients.

In 804, when performing decoding, inverse quantization on the coded bits of the core layer frequency-domain coefficients, the core layer coding sub-bands are divided into low-bit coding sub-bands and high-bit coding sub-bands according to the bit allocation numbers of the core layer coding sub-bands, and the inverse quantization is performed on the low-bit coding sub-bands and the high-bit coding sub-bands by using a pyramid lattice vector quantization/inverse quantization method and a spherical lattice vector quantization/inverse quantization method respectively.

The Huffman decoding is performed on the low-bit coding sub-bands or the natural decoding is performed directly on the low-bit coding sub-bands according to the side information of the core layer to obtain the pyramid lattice vector quantization indexes of the low-bit coding sub-bands, and inverse quantization and inverse normalization are performed on all the pyramid lattice vector quantization indexes, to obtain the frequency-domain coefficients of the coding sub-bands. The process of the pyramid lattice vector quantization/inverse quantization will be described hereinafter:

a, for all j=0, . . . , L_core−1, if Flag_huff_PLVQ_core=0, the $m^{th}$ vector quantization index index_b(j,m) of the low-bit coding sub-band j is obtained by directly decoding; and if Flag_huff_PLVQ_core=1, the $m^{th}$ vector quantization index index_b(j,m) of the low-bit coding sub-band j is obtained according to the Huffman coding code table corresponding to the bit allocation number of a single frequency-domain coefficient of the coding sub-band.

When the number of bits allocated to a single frequency-domain coefficient of the coding sub-band is 1, and if the natural binary code value of the quantization index is less than "1111 111", the quantization index is calculated according to the natural binary code value; and if the natural binary code value of the quantization index is equal to "1111 111", it is continued to read the next bit in, and if the next bit is 0, the quantization index value is 127, and if the next bit is 1, the quantization index value is 128.

b, the process of the pyramid lattice vector inverse quantization of the quantization indexes is an inverse process of the vector quantization 108, which is as follows:

1) an energy pyramid surface where the vector quantization index is located and a label on that energy pyramid surface are determined kk is searched in the pyramid surface energy from 2 to LargeK(region_bit(j)), so that the following inequality is met:

$$N(8,kk)<=\text{index_}b(j,m)<N(8,kk+2),$$

If such kk is found, then K=kk is the energy of the pyramid surface where the $D_8$ grid point to which the quantization index index_b(j,m) corresponds is located, b=index_b(j,m)−N(8,kk) is an index label of the $D_8$ grid point on the pyramid surface where the $D_8$ grid point is located;

If such kk cannot be found, the energy of the pyramid surface of the $D_8$ grid point to which the quantization index index_b(j,m) corresponds is K=0, and the index label is b=0.

2) the specific steps of solving the $D_8$ grid point vector Y=(y1, y2 y3, y4, y5, y6, y7, y8,) of which the energy of the pyramid surface is K and the index label is b are as follows:

in step 1, make Y=(0,0,0,0,0,0,0,0), xb=0, i=1, k=K, 1=8;

in step 2, if b=xb, then yi=0; and it is jumped to step 6;

in step 3, if b<xb+N(1−1,k), then yi=0, and it is jumped to step 5;

otherwise, xb=xb+N(1−1,k); and make j=1;

in step 4, if b<xb+2*N(1−1,k−j), then if xb<=b<xb+N(1−1,k−j), then yi=j;

if b>=xb+N(1−1,k−j), then yi=−j, xb=xb+N(1−1, k−j);

otherwise, xb=xb+2*N(1−1, k−j), j=j+1; and the present step continues;

in step 5, update k=k−|yi|, 1=1−1, i=i+1, and if k>0, then it is jumped to step 2;

in step 6, if k>0, then y8=k−|yi|, and Y=(y1, y2, . . . , y8) is the solved grid point.

3) the energy of the solved $D_8$ grid point is inversely regularized, to obtain:

$$\overline{Y}_j^m=(Y+a)/\text{scale(index)}$$

wherein, a=($2^{-6}$, $2^{-6}$, $2^{-6}$, $2^{-6}$, $2^{-6}$, $2^{-6}$, $2^{-6}$, $2^{-6}$), scale (index) is a scaling factor, which can be found from Table 5.

4) the inverse normalization process is performed on $\overline{Y}_j^m$, to obtain the frequency-domain coefficient of the $m^{th}$ vector of the coding sub-band j which is recovered by the decoding end:

$$\overline{X}_j^m=2^{Th_q(j)/2}\cdot\overline{Y}_j^m$$

wherein, $Th_q(j)$ is the amplitude envelope quantization index of the $j^{th}$ coding sub-band.

The natural decoding is directly performed on the coded bits of the high-bit coding sub-bands to obtain the $m^{th}$ index vector k of the high-bit coding sub-band j, and performing the inverse quantization process of the spherical lattice vector quantization on that index vector is actually an inverse process of the quantization process, and the specific steps are as follows:

a, x=k*G is calculated, and ytemp=x/(2^(region_bit(j)) is calculated; wherein, k is an index vector of the vector quantization, and region_bit(j) represents the bit allocation number of a single frequency-domain coefficient in the coding sub-band j; G is a generation matrix of $D_8$ grid points, and the form is as follows:

$$G = \begin{bmatrix} 2 & 0 & 0 & 0 & 0 & 0 & 0 & 0 \\ 1 & 1 & 0 & 0 & 0 & 0 & 0 & 0 \\ 1 & 0 & 1 & 0 & 0 & 0 & 0 & 0 \\ 1 & 0 & 0 & 1 & 0 & 0 & 0 & 0 \\ 1 & 0 & 0 & 0 & 1 & 0 & 0 & 0 \\ 1 & 0 & 0 & 0 & 0 & 1 & 0 & 0 \\ 1 & 0 & 0 & 0 & 0 & 0 & 1 & 0 \\ 1 & 0 & 0 & 0 & 0 & 0 & 0 & 1 \end{bmatrix}$$

b, y=x−$f_{D8}$(ytemp)*(2^(region_bit(j)) is calculated;

c, the energy of the solved $D_8$ grid points is inversely regularized, to obtain:

$$\overline{Y}_j^m = y^* \text{scale}(\text{region_bit}(j))/(2^{region_bit(j)}) + a,$$

wherein, a=($2^{-6}$, $2^{-6}$, $2^{-6}$, $2^{-6}$, $2^{-6}$, $2^{-6}$, $2^{-6}$, $2^{-6}$), scale (region_bit(j)) is a scaling factor, which can be found from Table 10.

d, the inverse normalization process is performed on $\overline{Y}_j^m$, to obtain frequency-domain coefficients of the $m^{th}$ vector of the coding sub-band j which is recovered by the decoding end:

$$\overline{X}_j^m = 2^{Th_q(j)/2} \cdot \overline{Y}_j^m$$

wherein, $Th_q(j)$ is the amplitude envelope quantization indexes of the $j^{th}$ coding sub-band.

In 805, the amplitude envelope quantization indexes of the sub-bands of the core layer residual signals are calculated by using the amplitude envelope quantization indexes of the core layer coding sub-bands and the bit allocation numbers of the core layer coding sub-bands; and the calculation method of the decoding end is totally the same as that of the coding end.

The Huffman coding or direct coding is performed on the amplitude envelope coded bits of the extended layer coding sub-bands according to a value of Flag_huff_rms_ext, to obtain the amplitude envelope quantization indexes $Th_q(j)$, j=,L_core, . . . , L−1 of the extended layer coding sub-bands.

In 806, the extended layer coding signals is comprised of the core layer residual signals and the extended layer frequency-domain coefficients, the initial values of the importance of the coding sub-bands of the extended layer coding signals are calculated according to the amplitude envelope quantization indexes of the coding sub-bands of the extended layer coding signals, and the bit allocation is performed on the coding sub-bands of the extended layer coding signals by using the initial values of the importance of the coding sub-bands of the extended layer coding signals, to obtain the bit allocation number of the coding sub-bands of the extended layer coding signals.

The method of calculating the initial values of the importance of the coding sub-bands of the decoding end and the bit allocation method are the same as those of the coding end.

In 807, the extended layer coding signals are calculated.

Decoding and inverse quantization are performed on the coded bits of the coding signals by using the bit allocation numbers of the extended layer coding signals, and the inverse normalization is performed on the inversely quantized data by using the quantized amplitude envelope values of the coding sub-bands of the extended layer coding signals, to obtain the extended layer coding signals.

The decoding and inverse quantization methods of the extended layer are the same as those of the core layer.

In the present step, the order of decoding of the coding sub-bands of the extended layer coding signals is determined according to the initial values of the importance of the coding sub-bands of the extended layer coding signals. If there are two coding sub-bands of the extended layer coding signals with the same importance, the low-frequency coding sub-band is preferably decoded, and meanwhile the number of the decoded bits is calculated, and when the number of the decoded bits meets the requirement on the total number of bits, the decoding is stopped.

For example, the bit rate of transmission from the coding end to the decoding end is 64 kbps; however, due to the network reasons, the decoding end can only obtain information of 48 kbps at the front of the bit stream, or the decoding end only supports the decoding of 48 kbps, and therefore, the decoding is stopped when the decoding end decodes to 48 kbps.

In 808, the coding signals obtained by decoding in the extended layer are rearranged in an order of the sub-bands, and the core layer frequency-domain coefficients with the same frequencies are added with the extended layer coding signals to obtain output values of the frequency-domain coefficients.

In 809, noise filling is performed on the sub-bands to which the coded bits are not allocated in the process of coding or on the sub-bands which are lost in the process of transmission.

In 810, when the transient detection flag bit Flag_transient is 1, the frequency-domain coefficients are rearranged, that is, all the frequency-domain coefficients corresponding to L sub-bands in Table 2 rearranged are into the corresponding locations of the original indexes of the frequency-domain coefficients, and the frequency-domain coefficients corresponding to the frequency-domain coefficient indexes which are not referred to in the Table 2 are set as 0.

In 811, the inverse time-frequency transform is performed on the frequency-domain coefficients, to obtain the final audio output signal. The specific steps are as follows.

When the transient detection flag bit Flag_transient is 0, an inverse $DCT_{IV}$ transform of which the length is N is performed on N-point frequency-domain coefficients, to obtain $\tilde{x}^q(n)$, n=0, . . . , N−1.

When the transient detection flag bit Flag_transient is 1, the N-point frequency domain coefficients are firstly divided into 4 groups with the same length, and the inverse time-domain aliasing processing and the inverse $DCT_{IV}$ transform of which the length is N/4 are performed on each group of frequency-domain coefficients, then a windowing process (the structure of the window is the same as that of the coding end) is performed on the 4 groups of obtained signals, and then the 4 groups of windowed signals are overlapped and added to obtain $\tilde{x}^q(n)$, n=0, . . . , N−1.

The inverse time-domain aliasing processing and the windowing process (the structure of the window is the same as that of the coding end) are performed on $\tilde{x}^q(n)$, n=0, . . . , N−1. Two adjacent frames are overlapped and added to obtain the final audio output signal.

Figure 9:
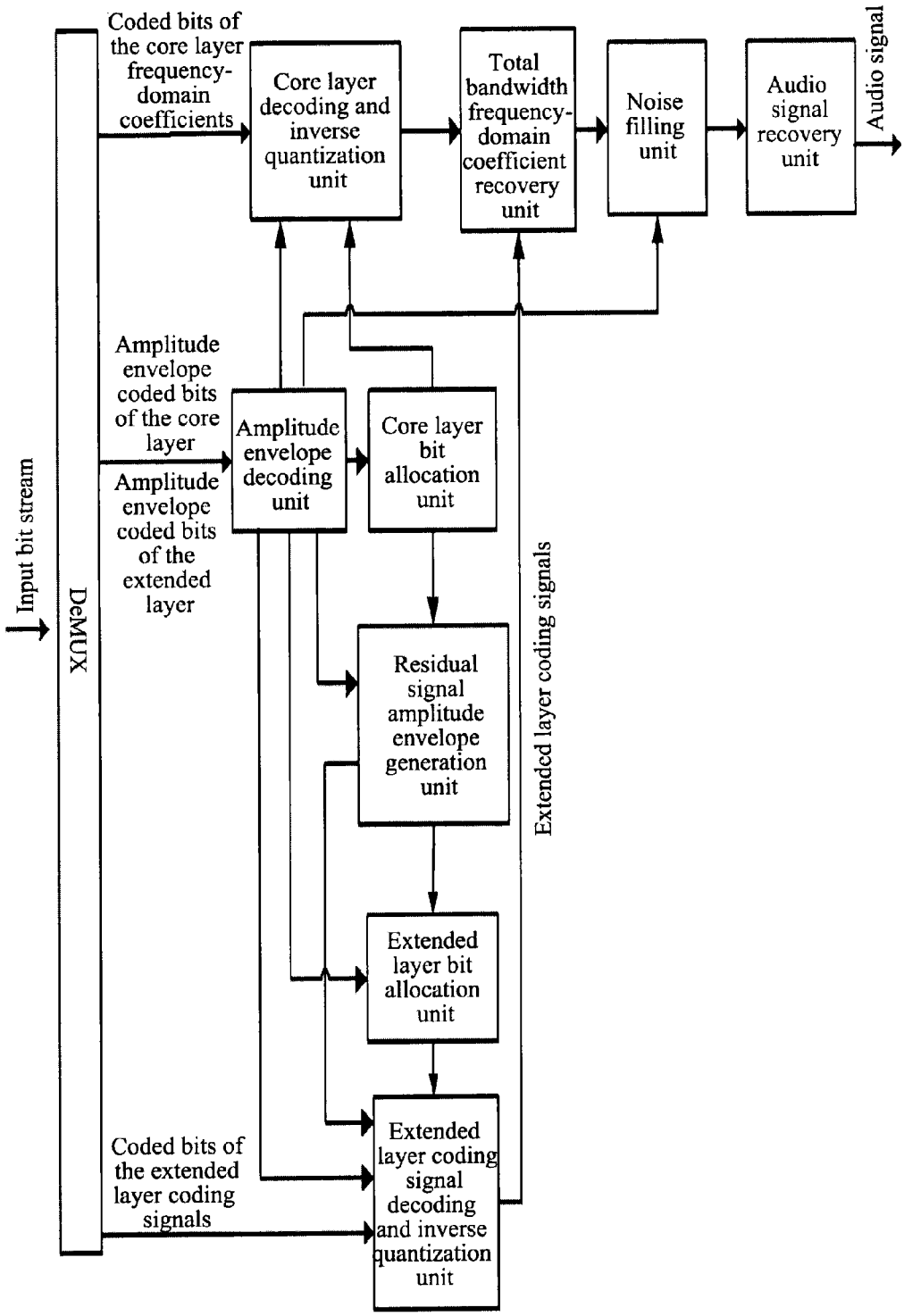
FIG. 9 is a structural diagram of a hierarchical audio decoding system according to the present invention.

FIG. 9 is a structural diagram of a hierarchical audio decoding system according to the present invention. As shown in FIG. 9, the system comprises: a bit stream demultiplexer (DeMUX), an amplitude envelope decoding unit of core layer coding sub-bands, a core layer bit allocation unit, and a core layer decoding and inverse quantization unit, a residual signal amplitude envelope generation unit, an extended layer bit allocation unit, an extended layer coding signal decoding and inverse quantization unit, an total bandwidth frequency-domain coefficient recovery unit, a noise filling unit and an audio signal recovery unit; wherein, the amplitude envelope decoding unit is connected with the bit stream demultiplexer, and is configured to: decode amplitude envelope coded bits of core layer coding sub-bands and extended layer coding sub-bands which are output by the bit stream demultiplexer, to obtain amplitude envelope quantization indexes of the core layer coding sub-bands and the extended layer coding sub-bands; and if transient detection information indicates a transient signal, further rearrange the amplitude envelope quantization indexes of the core layer coding sub-bands and the extended layer coding sub-bands so that their corresponding frequencies are aligned from low to high within the respective layers;

the core layer bit allocation unit is connected with the amplitude envelope decoding unit, and is configured to perform a bit allocation on the core layer coding sub-bands according to the amplitude envelope quantization indexes of the core layer coding sub-bands, to obtain bit allocation numbers of the core layer coding sub-bands;

the core layer decoding and inverse quantization unit is connected with the bit stream demultiplexer, the amplitude envelope decoding unit and the core layer bit allocation unit, and is configured to: calculate to obtain quantized amplitude envelope values of the core layer coding sub-bands according to the amplitude envelope quantization indexes of the core layer coding sub-bands, perform decoding, inverse quantization and inverse normalization process on coded bits of core layer frequency-domain coefficients output by the bit stream demultiplexer by using the bit allocation numbers and the quantized amplitude envelope values of the core layer coding sub-bands, to obtain the core layer frequency-domain coefficients;

the residual signal amplitude envelope generation unit is connected with the amplitude envelope decoding unit and the core layer bit allocation unit, and is configured to: look up a correction value statistical table of the amplitude envelope quantization indexes of the core layer residual signals according to the amplitude envelope quantization indexes of the core layer coding sub-bands and the bit allocation numbers of the corresponding coding sub-bands, to obtain the amplitude envelope quantization indexes of the core layer residual signals;

the extended layer bit allocation unit is connected with the residual signal amplitude envelope generation unit and the amplitude envelope decoding unit, and is configured to: perform the bit allocation on coding sub-bands of extended layer coding signals according to the amplitude envelope quantization indexes of the core layer residual signals and the amplitude envelope quantization indexes of the extended layer coding sub-bands, to obtain bit allocation numbers of the coding sub-bands of the extended layer coding signals;

the extended layer coding signal decoding and inverse quantization unit is connected with the bit stream demultiplexer, the amplitude evenlop decoding unit, the extended layer bit allocation unit and the residual signal amplitude envelope generation unit, and is configured to: calculate to obtain quantized amplitude envelope values of the coding sub-bands of the extended layer coding signals by using the amplitude envelope quantization indexes of the coding sub-bands of the extended layer coding signals, and perform the decoding, the inverse quantization, and the inverse normalization process on coded bits of the extended layer coding signals which are output by the bit stream demultiplexer by using the bit allocation numbers and the quantized amplitude envelope values of the coding sub-bands of the extended layer coding signals, to obtain the extended layer coding signals;

the total bandwidth frequency-domain coefficient recovery unit is connected with the core layer decoding and inverse quantization unit and the extended layer coding signal decoding and inverse quantization unit, and is configured to: rearrange the extended layer coding signals output by the extended layer coding signal decoding and inverse quantization unit in an order of coding sub-bands, and then add with the core layer frequency-domain coefficients output by the core layer decoding and inverse quantization unit, to obtain the frequency-domain coefficients of the total bandwidth;

the noise filling unit is connected with the total bandwidth frequency-domain coefficient recovery unit and the amplitude envelope decoding unit, and is configured to perform noise filling on sub-bands to which coded bits are not allocated in the process of coding;

the audio signal recovery unit is connected with the noise filling unit, and is configured to: if the transient detection information indicates a steady-state signal, directly perform an inverse time-frequency transform on the frequency-domain coefficients of the total bandwidth, to obtain an audio signal for output; and if the transient detection information indicates a transient signal, rearrange the frequency-domain coefficients of the total bandwidth, then divide into M groups of frequency-domain coefficients, perform the inverse time-frequency transform on each group of frequency-domain coefficients, and calculate to obtain a final audio signal according to M groups of time-domain signals obtained by transformation.

The residual signal amplitude envelope generation unit further comprises a quantization index correction value acquiring module and a residual signal amplitude envelope quantization index calculation module;

the quantization index correction value acquiring module is configured to search for a correction value statistical table of the amplitude envelope quantization indexes of the core layer residual signals according to the bit allocation numbers of the core layer coding sub-bands to obtain correction values of the quantization indexes of the coding sub-bands of the residual signals, wherein, the correction value of the quantization index of each coding sub-band is larger than or equal to 0, and does not decrease when the bit allocation number of the corresponding core layer coding sub-band increases, and if the bit allocation number of a certain core layer coding sub-band is 0, the correction value of the quantization index of the core layer residual signal at that coding sub-band is 0, and if the bit allocation number of a certain core layer coding sub-band is a defined maximum bit allocation number, the amplitude envelope value of the residual signal at that coding sub-band is 0; and the residual signal amplitude envelope quantization index calculation module is configured to perform a difference calculation between the amplitude envelope quantization index of the core layer coding sub-band and the correction value of the quantization index of the corresponding coding sub-band, to obtain the amplitude envelope quantization index of the coding sub-band of the core layer residual signal.

The extended layer coding signal decoding and inverse quantization unit is further configured to: determine the order of decoding the coding sub-bands of the extended layer coding signals according to initial values of importance of the coding sub-bands of the extended layer coding signals, preferentially decode the coding sub-bands of the extended layer coding signals with the large importance; and if there are two coding sub-bands of the extended layer coding signals with the same importance, preferentially decode the coding sub-bands with a low frequency, and calculate the number of the decoded bits in the process of decoding; and when the number of the decoded bits meets the requirement on the total number of bits, stop decoding.

The order of decoding of the coding sub-bands of the extended layer coding signals by the extended layer coding signal decoding and inverse quantization unit is determined according to initial values of importance of the coding sub-bands of the extended layer coding signals, preferentially decode the coding sub-bands of the extended layer coding signals with the large importance; and if there are two coding sub-bands of the extended layer coding signals with the same importance, preferentially decode the coding sub-bands with a low frequency, and calculate the number of the decoded bits in the process of decoding; and when the number of the decoded bits meets the requirement on the total number of bits, stop decoding.

rearranging the frequency-domain coefficients of the total bandwidth by the audio signal recovery unit specifically is: arranging the frequency-domain coefficients so that their corresponding coding sub-bands are aligned from low frequencies to high frequencies within respective sub-frames, to obtain M groups of frequency-domain coefficients, and then arranging the M groups of frequency-domain coefficients in an order of sub-frames.

If the transient detection information indicates a transient signal, the process of calculating to obtain the final audio signal by the audio signal recovery unit according to M groups of time-domain signals obtained by transformation specifically comprises: performing an inverse time-domain aliasing processing on each group of time-domain signals, then performing a windowing process on the M groups of obtained signals, and then overlapping and adding the M groups of windowed signals, to obtain a N-point time-domain-sampled signal $\tilde{x}^q(n)$; and performing the inverse time-domain aliasing processing and the windowing process on the time-domain signal $\tilde{x}^q(n)$, and overlapping and adding two adjacent frames, to obtain the final audio output signal.

The present invention further provides hierarchical coding and decoding methods for transient signals as follows.

The hierarchical audio coding method for the transient signals according to the present invention comprises:

A1, dividing an audio signal into M sub-frames, performing a time-frequency transform on each sub-frame, the M groups of frequency-domain coefficients obtained by transformation constituting total frequency-domain coefficients of a current frame, rearranging the total frequency-domain coefficients so that their corresponding coding sub-bands are aligned from low frequencies to high frequencies, wherein, the total frequency-domain coefficients comprise core layer frequency-domain coefficients and extended layer frequency-domain coefficients, the coding sub-bands comprise core layer coding sub-bands and extended layer coding sub-bands, the core layer frequency-domain coefficients constitute several core layer coding sub-bands, and the extended layer frequency-domain coefficients constitute several extended layer coding sub-bands;

B1, quantizing and coding amplitude envelope values of the core layer coding sub-bands and the extended layer coding sub-bands, to obtain amplitude envelope quantization indexes and coded bits of the core layer coding sub-bands and the extended layer coding sub-bands; wherein, the amplitude envelope values of the core layer coding sub-bands and the extended layer coding sub-bands are separately quantized respectively, and the amplitude envelope quantization indexes of the core layer coding sub-bands and the amplitude envelope quantization indexes of the extended layer coding sub-bands are rearranged respectively;

C1, performing a bit allocation on the core layer coding sub-bands according to the amplitude envelope quantization indexes of the core layer coding sub-bands, and then quantizing and coding the core layer frequency-domain coefficients to obtain coded bits of the core layer frequency-domain coefficients;

D1, inversely quantizing the above-described frequency-domain coefficients in the core layer which are performed with a vector quantization, and perform a difference calculation with original frequency-domain coefficients obtained after being performed with the time-frequency transform, to obtain core layer residual signals;

E1, calculating amplitude envelope quantization indexes of coding sub-bands of the core layer residual signals according to the amplitude envelope quantization indexes and bit allocation numbers of the core layer coding sub-bands;

F1, performing a bit allocation on coding sub-bands of extended layer coding signals according to the amplitude envelope quantization indexes of the core layer residual signals and the amplitude envelope quantization indexes of the extended layer coding sub-bands, and then quantizing and coding the extended layer coding signals to obtain coded bits of the extended layer coding signals, wherein, the extended layer coding signals are comprised of the core layer residual signals and the extended layer frequency-domain coefficients; and G1, multiplexing and packeting the amplitude envelope coded bits of the core layer coding sub-bands and the extended layer coding sub-bands, the coded bits of the core layer frequency-domain coefficients and the coded bits of the extended layer coding signals, and then transmitting to a decoding end.

In step A1, the method of obtaining the total frequency-domain coefficients of the current frame comprises:

composing a 2N-point time-domain-sampled signal $\bar{x}(n)$ by a N-point time-domain-sampled signal x(n) of the current frame and a N-point time-domain-sampled signal $x_{old}(n)$ of the last frame, and then performing windowing and time-domain aliasing processing on $\bar{x}(n)$ to obtain a N-point time-domain-sampled signal $\tilde{x}(n)$; and performing a reversing processing on the time-domain signal $\tilde{x}(n)$, subsequently adding a sequence of zeros at both ends of the signal respectively, dividing the lengthened signal into M sub-frames which are overlapped with each other, and then performing the windowing, the time-domain aliasing processing and the time-frequency transform on the time-domain signal of each sub-frame, to obtain M groups of frequency-domain coefficients and then constitute the total frequency-domain coefficients of the current frame.

In step A1, when rearranging the frequency-domain coefficients, the frequency-domain coefficients are rearranged so that their corresponding coding sub-bands are aligned from low frequencies to high frequencies within the core layer and within the extended layer.

In step B1, rearranging the amplitude envelope quantization indexes specifically comprises:

rearranging the amplitude envelope quantization indexes of the coding sub-bands within the same sub-frame together so that their corresponding frequencies are aligned in an ascending or descending order, and connecting by using two coding sub-bands which represent peer-to-peer frequencies and belong to two sub-frames respectively at a sub-frame boundaries.

In step G1, the multiplexing and packeting are performed in accordance with the following bit stream format:

firstly, writing the side information bits of the core layer at the back of a frame head of the bit stream, writing the amplitude envelope coded bits of the core layer coding sub-bands into a bit stream multiplexer (MUX), and then writing the coded bits of the core layer frequency-domain coefficients into the MUX;

then, writing the side information bits of the extended layer into the MUX, then writing the amplitude envelope coded bits of the coding sub-bands of the extended layer frequency-domain coefficients into the MUX, and then writing the coded bits of the extended layer coding signals into the MUX; and transmitting the number of bits which meets the requirement on the bit rate to the decoding end according to the required bit rate.

The side information of the core layer comprises a transient detection flag bit, a Huffman coding flag bit of the amplitude envelopes of the core layer coding sub-bands, a Huffman coding flag bit of the core layer frequency-domain coefficients and a bit of the number of times of iteration of the bit allocation correction of the core layer.

The side information of the extended layer comprises a Huffman coding flag bit of an amplitude envelopes of extended layer coding sub-bands, a Huffman coding flag bit of the extended layer coding signals and a bit of the number of times of iteration of the bit allocation correction of the extended layer.

The hierarchical decoding method for transient signals according to the present invention comprises:

in step A2, demultiplexing a bit stream transmitted by a coding end, decoding amplitude envelope coded bits of core layer coding sub-bands and extended layer coding sub-bands, to obtain amplitude envelope quantization indexes of the core layer coding sub-bands and the extended layer coding sub-bands, rearranging the amplitude envelope quantization indexes of the core layer coding sub-bands and the extended layer coding sub-bands respectively so that their corresponding frequencies are aligned from low to high within the respective layers;

in step B2, performing a bit allocation on the core layer coding sub-bands according to the rearranged amplitude envelope quantization indexes of the core layer coding sub-bands, and thus calculating amplitude envelope quantization indexes of core layer residual signals;

in step C2, performing the bit allocation on coding sub-bands of the extended layer coding signals according to the amplitude envelope quantization indexes of the core layer residual signals and the rearranged amplitude envelope quantization indexes of the extended layer coding sub-bands;

in step D2, decoding coded bits of core layer frequency-domain coefficients and coded bits of extended layer coding signals respectively according to bit allocation numbers of the core layer and the extended layer, to obtain the core layer frequency-domain coefficients and the extended layer coding signals, and rearranging the extended layer coding signals in an order of sub-bands and adding with the core layer frequency-domain coefficients, to obtain frequency-domain coefficients of total bandwidth; and in step E2, rearranging the frequency-domain coefficients of the total bandwidth, and then dividing into M groups, performing an inverse time-frequency transform on each group of frequency-domain coefficients, and calculating to obtain a final audio signal according to M groups of time-domain signals obtained by transformation.

In step E2, rearranging the frequency-domain coefficients of the total bandwidth specifically comprises arranging the frequency-domain coefficients so that their corresponding coding sub-bands are aligned from low frequencies to high frequencies within respective sub-frames, to obtain M groups of frequency-domain coefficients, and then arranging the M groups of frequency-domain coefficients in an order of sub-frames.

In step E2, the process of calculating to obtain the final audio signal according to M groups of time-domain signals obtained by transformation comprises: performing an inverse time-domain aliasing processing on each group, then performing a windowing process on the M groups of obtained signals, and then overlapping and adding the M groups of windowed signals, to obtain a N-point time-domain-sampled signal $\tilde{x}^q(n)$; and performing the inverse time-domain aliasing processing and the windowing process on the time-domain signal $\tilde{x}^q(n)$, and overlapping and adding two adjacent frames, to obtain the final audio output signal.

Industrial Applicability

In the present invention, by introducing a processing method for transient signal frames in the hierarchical audio coding and decoding methods, a segmented time-frequency transform is performed on the transient signal frames, and then the frequency-domain coefficients obtained by transformation are rearranged respectively within the core layer and within the extended layer, so as to perform the same subsequent coding processes, such as bit allocation, frequency-domain coefficient coding, etc., as those on the steady-state signal frames, thus enhancing the coding efficiency of the transient signal frames and improving the quality of the hierarchical audio coding and decoding.

What is claimed is:

1. A hierarchical audio coding method, comprising:

performing a transient detection on an audio signal of a current frame;

when the transient detection is to be a steady-state signal, performing a time-frequency transform on an audio signal to obtain total frequency-domain coefficients; when the transient detection is to be a transient signal, dividing the audio signal into M sub-frames, performing the time-frequency transform on each sub-frame, M groups of frequency-domain coefficients obtained by transformation constituting total frequency-domain coefficients of the current frame, rearranging the total frequency-domain coefficients so that their corresponding coding sub-bands are aligned from low frequencies to high frequencies, wherein, the total frequency-domain coefficients comprise core layer frequency-domain coefficients and extended layer frequency-domain coefficients, the coding sub-bands comprise core layer coding sub-bands and extended layer coding sub-bands, the core layer frequency-domain coefficients constitute several core layer coding sub-bands, and the extended layer frequency-domain coefficients constitute several extended layer coding sub-bands;

quantizing and coding amplitude envelope values of the core layer coding sub-bands and the extended layer coding sub-bands, to obtain amplitude envelope quantization indexes and amplitude envelope coded bits of the core layer coding sub-bands and the extended layer coding sub-bands; wherein, if the signal is the steady-state signal, the amplitude envelope values of the core layer coding sub-bands and the extended layer coding sub-bands are jointly quantized, and if the signal is the transient signal, the amplitude envelope values of the core layer coding sub-bands and the extended layer coding sub-bands are separately quantized respectively, and the amplitude envelope quantization indexes of the core layer coding sub-bands and the amplitude envelope quantization indexes of the extended layer coding sub-bands are rearranged respectively;

performing a bit allocation on the core layer coding sub-bands according to the amplitude envelope quantization indexes of the core layer coding sub-bands, and then quantizing and coding the core layer frequency-domain coefficients to obtain coded bits of the core layer frequency-domain coefficients;

inversely quantizing the above-described frequency-domain coefficients in a core layer which are performed with a vector quantization, and performing a difference calculation between the inversely quantized frequency-domain coefficients and original frequency-domain coefficients, which are obtained after being performed with the time-frequency transform, to obtain core layer residual signals;

calculating the amplitude envelope quantization indexes of the core layer residual signals according to bit allocation numbers and the amplitude envelope quantization indexes of the core layer coding sub-bands;

performing the bit allocation on coding sub-bands of extended layer coding signals according to the amplitude envelope quantization indexes of the core layer residual signals and the amplitude envelope quantization indexes of the extended layer coding sub-bands, and then quantizing and coding the extended layer coding signals to obtain coded bits of the extended layer coding signals, wherein, the extended layer coding signals are composed of the core layer residual signals and the extended layer frequency-domain coefficients; and multiplexing and packeting the amplitude envelope coded bits of the core layer coding sub-bands and the extended layer coding sub-bands, the coded bits of the core layer frequency-domain coefficients and the coded bits of the extended layer coding signals, and then transmitting to a decoding end.

2. The method according to claim 1, wherein, when the transient detection is to be the transient signal and the frequency-domain coefficients are rearranged, the frequency-domain coefficients are rearranged so that their corresponding coding sub-bands are aligned from low frequencies to high frequencies within the core layer and within the extended layer respectively.

3. The method according to claim 2, wherein, when rearranging respectively within the core layer and within the extended layer, if the frequency-domain coefficients remained in a group is not enough to constitute one sub-band, then a supplement is performed by using frequency-domain coefficients with the same or similar frequencies in the next group of frequency-domain coefficients.

4. The method according to claim 2, the indexes of the frequency-domain coefficients in the coding sub-bands after rearranging is as follows:

| Serial number of sub-band | Index of starting frequency-domain coefficient (LIndex) | Index of ending frequency-domain coefficient (HIndex) |
|---|---|---|
| 0 | 0 | 15 |
| 1 | 160 | 175 |
| 2 | 320 | 335 |

-continued

| Serial number of sub-band | Index of starting frequency-domain coefficient (LIndex) | Index of ending frequency-domain coefficient (HIndex) |
|---|---|---|
| 3 | 480 | 495 |
| 4 | 16 | 31 |
| 5 | 176 | 191 |
| 6 | 336 | 351 |
| 7 | 496 | 511 |
| 8 | 32 | 47 |
| 9 | 192 | 207 |
| 10 | 352 | 367 |
| 11 | 512 | 527 |
| 12 | 48 | 63 |
| 13 | 208 | 223 |
| 14 | 368 | 383 |
| 15 | 528 | 543 |
| 16 | 64, 65, 66, 67, 68, 69, 70, 71, 224, 225, 226, 227, 228, 229, 230, 231 | |
| 17 | 384, 385, 386, 387, 388, 389, 390, 391, 544, 545, 546, 547, 548, 549, 550, 551 | |
| 18 | 72 | 87 |
| 19 | 232 | 247 |
| 20 | 392 | 407 |
| 21 | 552 | 567 |
| 22 | 88 | 103 |
| 23 | 248 | 263 |
| 24 | 408 | 423 |
| 25 | 568 | 583 |
| 26 | 104 | 135 |
| 27 | 264 | 295 |
| 28 | 424 | 455 |
| 29 | 584 | 615. |

5. The method according to claim 1, further comprising: when the transient detection is to be the steady-state signal, performing Huffman coding on the amplitude envelope quantization indexes of the core layer coding sub-bands obtained by quantization; and if the total number of bits consumed after the Huffman coding is performed on the amplitude envelope quantization indexes of all the core layer coding sub-bands is less than the total number of bits consumed after natural coding is performed on the amplitude envelope quantization indexes of all the core layer coding sub-bands, using the Huffman coding, otherwise, using the natural coding, and setting amplitude envelope Huffman coding flag of the core layer coding sub-bands; and performing the Huffman coding on the amplitude envelope quantization indexes of the extended layer coding sub-bands obtained by quantization; and if the total number of bits consumed after the Huffman coding is performed on the amplitude envelope quantization indexes of all the extended layer coding sub-bands is less than the total number of bits consumed after the natural coding is performed on the amplitude envelope quantization indexes of all the extended layer coding sub-bands, using the Huffman coding, otherwise, using the natural coding, and setting the amplitude envelope Huffman coding flag of the extended layer coding sub-bands.

6. The method according to claim 1, wherein, quantizating and coding the core layer frequency-domain coefficients comprises:

performing Huffman coding on all the quantization indexes of the core layer which are obtained by using a pyramid lattice vector quantization;

if the total number of bits consumed after the Huffman coding is performed on all the quantization indexes obtained by using the pyramid lattice vector quantization is less than the total number of bits consumed after natural coding is performed on all the quantization indexes obtained by using the pyramid lattice vector quantization, using the Huffman coding, correcting the bit allocation numbers of the coding sub-bands by using the number of bits saved by the Huffman coding, the number of bits remained after a first bit allocation, and the total number of bits saved by coding all the coding sub-bands in which the number of bits allocated to a single frequency-domain coefficient is 1 or 2, and performing the vector quantization and the Huffman coding again on the coding sub-bands of which the bit allocation numbers are corrected; otherwise, using the natural coding, correcting the bit allocation numbers of the coding sub-bands by using the number of bits remained after a first bit allocation and the total number of bits saved by coding all the coding sub-bands in which the number of bits allocated to a single frequency-domain coefficient is 1 or 2, and performing the vector quantization and the natural coding again on the coding sub-bands of which the bit allocation numbers are corrected; and quantizating and coding the extended layer coding signals comprises:

performing Huffman coding on all the quantization indexes of the extended layer which are obtained by using the pyramid lattice vector quantization;

if the total number of bits consumed after the Huffman coding is performed on all the quantization indexes obtained by using the pyramid lattice vector quantization is less than the total number of bits consumed after natural coding is performed on all the quantization indexes obtained by using the pyramid lattice vector quantization, using the Huffman coding, correcting the bit allocation numbers of the coding sub-bands by using the number of bits saved by the Huffman coding, the number of bits remained after a first bit allocation, and the total number of bits saved by coding all the coding sub-bands in which the number of bits allocated to a single frequency-domain coefficient is 1 or 2, and performing the vector quantization and the Huffman coding again on the coding sub-bands of which the bit allocation numbers are corrected; otherwise, using the natural coding, correcting the bit allocation numbers of the coding sub-bands by using the number of bits remained after a first bit allocation and the total number of bits saved by coding all the coding sub-bands in which the number of bits allocated to a single frequency-domain coefficient is 1 or 2, and performing the vector quantization and the natural coding again on the coding sub-bands of which the bit allocation numbers are corrected.

7. The method according to claim 1, the indexes of the frequency-domain coefficients in the coding sub-bands after rearranging is as follows:

| Serial number of sub-band | Index of starting frequency-domain coefficient (LIndex) | Index of ending frequency-domain coefficient (HIndex) |
|---|---|---|
| 0 | 0 | 15 |
| 1 | 160 | 175 |
| 2 | 320 | 335 |
| 3 | 480 | 495 |
| 4 | 16 | 31 |
| 5 | 176 | 191 |
| 6 | 336 | 351 |
| 7 | 496 | 511 |
| 8 | 32 | 47 |
| 9 | 192 | 207 |
| 10 | 352 | 367 |
| 11 | 512 | 527 |

-continued

| Serial number of sub-band | Index of starting frequency-domain coefficient (LIndex) | Index of ending frequency-domain coefficient (HIndex) |
|---|---|---|
| 12 | 48 | 63 |
| 13 | 208 | 223 |
| 14 | 368 | 383 |
| 15 | 528 | 543 |
| 16 | 64, 65, 66, 67, 68, 69, 70, 71, 224, 225, 226, 227, 228, 229, 230, 231 | |
| 17 | 384, 385, 386, 387, 388, 389, 390, 391, 544, 545, 546, 547, 548, 549, 550, 551 | |
| 18 | 72 | 87 |
| 19 | 232 | 247 |
| 20 | 392 | 407 |
| 21 | 552 | 567 |
| 22 | 88 | 103 |
| 23 | 248 | 263 |
| 24 | 408 | 423 |
| 25 | 568 | 583 |
| 26 | 104 | 135 |
| 27 | 264 | 295 |
| 28 | 424 | 455 |
| 29 | 584 | 615. |

8. A hierarchical audio decoding method, comprising:

demultiplexing a bit stream transmitted by a coding end, decoding amplitude envelope coded bits of core layer coding sub-bands and extended layer coding sub-bands, to obtain amplitude envelope quantization indexes of the core layer coding sub-bands and the extended layer coding sub-bands; if transient detection information indicates a transient signal, further rearranging the amplitude envelope quantization indexes of the core layer coding sub-bands and the extended layer coding sub-bands respectively so that their corresponding frequencies are aligned from low to high within the respective layers;

performing a bit allocation on the core layer coding sub-bands according to the amplitude envelope quantization indexes of the core layer coding sub-bands, thus calculating amplitude envelope quantization indexes of core layer residual signals, and performing the bit allocation on coding sub-bands of extended layer coding signals according to the amplitude envelope quantization indexes of the core layer residual signals and the amplitude envelope quantization indexes of the extended layer coding sub-bands;

decoding coded bits of core layer frequency-domain coefficients and coded bits of the extended layer coding signals respectively according to bit allocation numbers of the core layer coding sub-bands and the coding sub-bands of the extended layer coding signals, to obtain the core layer frequency-domain coefficients and the extended layer coding signals, added rearranging the extended layer coding signals in an order of sub-bands, added with the core layer frequency-domain coefficients, to obtain frequency-domain coefficients of total bandwidth; and if the transient detection information indicates a steady-state signal, directly performing an inverse time-frequency transform on the frequency-domain coefficients of the total bandwidth, to obtain an audio signal for output; and if the transient detection information indicates a transient signal, rearranging the frequency-domain coefficients of the total bandwidth, then dividing into M groups of frequency-domain coefficients, performing the inverse time-frequency transform on each group of frequency-domain coefficients, and calculating to obtain a final audio signal according to M groups of time-domain signals obtained by transformation.

9. The method according to claim 8, wherein, if the transient detection information indicates the transient signal, rearranging the frequency-domain coefficients of the total bandwidth comprises: arranging the frequency-domain coefficients so that their corresponding coding sub-bands are aligned from low frequencies to high frequencies within respective sub-frames, to obtain M groups of frequency-domain coefficients, and then arranging the M groups of frequency-domain coefficients in an order of sub-frames.

10. A hierarchical audio coding method for transient signals, comprising:

dividing an audio signal into M sub-frames, performing a time-frequency transform on each sub-frame, M groups of frequency-domain coefficients obtained by transformation constituting total frequency-domain coefficients of a current frame, rearranging the total frequency-domain coefficients so that their corresponding coding sub-bands are aligned from low frequencies to high frequencies, wherein, the total frequency-domain coefficients comprise core layer frequency-domain coefficients and extended layer frequency-domain coefficients, the coding sub-bands comprise core layer coding sub-bands and extended layer coding sub-bands, the core layer frequency-domain coefficients constitute several core layer coding sub-bands, and the extended layer frequency-domain coefficients constitute several extended layer coding sub-bands;

quantizing and coding amplitude envelope values of the core layer coding sub-bands and the extended layer coding sub-bands, to obtain amplitude envelope quantization indexes and coded bits of the core layer coding sub-bands and the extended layer coding sub-bands; wherein, the amplitude envelope values of the core layer coding sub-bands and the extended layer coding sub-bands are separately quantized respectively, and the amplitude envelope quantization indexes of the core layer coding sub-bands and the amplitude envelope quantization indexes of the extended layer coding sub-bands are rearranged respectively;

performing a bit allocation on the core layer coding sub-bands according to the amplitude envelope quantization indexes of the core layer coding sub-bands, and then quantizing and coding the core layer frequency-domain coefficients to obtain coded bits of the core layer frequency-domain coefficients;

inversely quantizing the above-described frequency-domain coefficients in a core layer which are performed with a vector quantization, and performing a difference calculation between the inversely quantized frequency-domain coefficients and original frequency-domain coefficients, which are obtained after being performed with the time-frequency transform, to obtain core layer residual signals;

calculating amplitude envelope quantization indexes of coding sub-bands of the core layer residual signals according to the amplitude envelope quantization indexes of the core layer coding sub-bands and bit allocation numbers of the core layer coding sub-bands;

performing a bit allocation on coding sub-bands of extended layer coding signals according to the amplitude envelope quantization indexes of the core layer residual signals and the amplitude envelope quantization indexes of the extended layer coding sub-bands, and then quantizing and coding the extended layer coding signals to obtain coded bits of the extended layer coding signals, wherein, the extended layer coding signals are composed of the core layer residual signals and the extended layer frequency-domain coefficients; and multiplexing and packeting the amplitude envelope coded bits of the core layer coding sub-bands and the extended layer coding sub-bands, the coded bits of the core layer frequency-domain coefficients and the coded bits of the extended layer coding signals, and then transmitting to a decoding end.

11. The method according to claim 10, wherein, the frequency-domain coefficients are rearranged so that their corresponding coding sub-bands are aligned from low frequencies to high frequencies within the core layer and within the extended layer respectively.

12. The method according to claim 11, wherein, when rearranging respectively within the core layer and within the extended layer, if the frequency-domain coefficients remained in a group is not enough to constitute one sub-band, then a supplement is performed by using frequency-domain coefficients with the same or similar frequencies in the next group of the frequency-domain coefficients.

13. The method according to claim 11, the indexes of the frequency-domain coefficients in the coding sub-bands after rearranging is as follows:

| Serial number of sub-band | Index of starting frequency-domain coefficient (LIndex) | Index of ending frequency-domain coefficient (HIndex) |
|---|---|---|
| 0 | 0 | 15 |
| 1 | 160 | 175 |
| 2 | 320 | 335 |
| 3 | 480 | 495 |
| 4 | 16 | 31 |
| 5 | 176 | 191 |
| 6 | 336 | 351 |
| 7 | 496 | 511 |
| 8 | 32 | 47 |
| 9 | 192 | 207 |
| 10 | 352 | 367 |
| 11 | 512 | 527 |
| 12 | 48 | 63 |
| 13 | 208 | 223 |
| 14 | 368 | 383 |
| 15 | 528 | 543 |
| 16 | 64, 65, 66, 67, 68, 69, 70, 71, 224, 225, 226, 227, 228, 229, 230, 231 | |
| 17 | 384, 385, 386, 387, 388, 389, 390, 391, 544, 545, 546, 547, 548, 549, 550, 551 | |
| 18 | 72 | 87 |
| 19 | 232 | 247 |
| 20 | 392 | 407 |
| 21 | 552 | 567 |
| 22 | 88 | 103 |
| 23 | 248 | 263 |
| 24 | 408 | 423 |
| 25 | 568 | 583 |
| 26 | 104 | 135 |
| 27 | 264 | 295 |
| 28 | 424 | 455 |
| 29 | 584 | 615. |

14. The method according to claim 10, the indexes of the frequency-domain coefficients in the coding sub-bands after rearranging is as follows:

| Serial number of sub-band | Index of starting frequency-domain coefficient (LIndex) | Index of ending frequency-domain coefficient (HIndex) |
|---|---|---|
| 0 | 0 | 15 |
| 1 | 160 | 175 |

-continued

| Serial number of sub-band | Index of starting frequency-domain coefficient (LIndex) | Index of ending frequency-domain coefficient (HIndex) |
|---|---|---|
| 2 | 320 | 335 |
| 3 | 480 | 495 |
| 4 | 16 | 31 |
| 5 | 176 | 191 |
| 6 | 336 | 351 |
| 7 | 496 | 511 |
| 8 | 32 | 47 |
| 9 | 192 | 207 |
| 10 | 352 | 367 |
| 11 | 512 | 527 |
| 12 | 48 | 63 |
| 13 | 208 | 223 |
| 14 | 368 | 383 |
| 15 | 528 | 543 |
| 16 | 64, 65, 66, 67, 68, 69, 70, 71, 224, 225, 226, 227, 228, 229, 230, 231 | |
| 17 | 384, 385, 386, 387, 388, 389, 390, 391, 544, 545, 546, 547, 548, 549, 550, 551 | |
| 18 | 72 | 87 |
| 19 | 232 | 247 |
| 20 | 392 | 407 |
| 21 | 552 | 567 |
| 22 | 88 | 103 |
| 23 | 248 | 263 |
| 24 | 408 | 423 |
| 25 | 568 | 583 |
| 26 | 104 | 135 |
| 27 | 264 | 295 |
| 28 | 424 | 455 |
| 29 | 584 | 615. |

15. A hierarchical decoding method for transient signals, comprising:

demultiplexing a bit stream transmitted by a coding end, decoding amplitude envelope coded bits of core layer coding sub-bands and extended layer coding sub-bands, to obtain amplitude envelope quantization indexes of the core layer coding sub-bands and the extended layer coding sub-bands, rearranging the amplitude envelope quantization indexes of the core layer coding sub-bands and the extended layer coding sub-bands respectively so that their corresponding frequencies are aligned from low to high within the respective layers;

performing a bit allocation on the core layer coding sub-bands according to the rearranged amplitude envelope quantization indexes of the core layer coding sub-bands, and thus calculating amplitude envelope quantization indexes of core layer residual signals;

performing the bit allocation on the extended layer coding sub-bands according to the amplitude envelope quantization indexes of the core layer residual signals and the rearranged amplitude envelope quantization indexes of the extended layer coding sub-bands;

decoding coded bits of core layer frequency-domain coefficients and coded bits of extended layer coding signals respectively according to bit allocation numbers of the core layer coding sub-bands and coding sub-bands of the extended layer coding signals, to obtain the core layer frequency-domain coefficients and the extended layer coding signals, and rearranging the extended layer coding signals in an order of the sub-bands, added with the core layer frequency-domain coefficients, to obtain frequency-domain coefficients of total bandwidth; and rearranging the frequency-domain coefficients of the total bandwidth, and then dividing into M groups, performing an inverse time-frequency transform on each group of frequency-domain coefficients, and calculating to obtain a final audio signal according to M groups of time-domain signals obtained by transformation.

16. The method according to claim 15, wherein, the step of rearranging the frequency-domain coefficients of the total bandwidth comprises: arranging the frequency-domain coefficients so that their corresponding coding sub-bands are aligned from low frequencies to high frequencies within respective sub-frames, to obtain M groups of frequency-domain coefficients, and then arranging the M groups of frequency-domain coefficients in an order of sub-frames.

17. A hierarchical audio coding system, comprising:

a frequency-domain coefficient generation unit, an amplitude envelope calculation unit, an amplitude envelope quantization and coding unit, a core layer bit allocation unit, a core layer frequency-domain coefficient vector quantization and coding unit, and a bit stream multiplexer; and further comprising: a transient detection unit, an extended layer coding signal generation unit, a residual signal amplitude envelope generation unit, an extended layer bit allocation unit, and an extended layer coding signal vector quantization and coding unit; wherein, the transient detection unit is configured to perform a transient detection on an audio signal of a current frame;

the frequency-domain coefficient generation unit is connected with the transient detection unit, and is configured to: when the transient detection is to be a steady-state signal, perform a time-frequency transform on an audio signal to obtain total frequency-domain coefficients; when the transient detection is to be a transient signal, divide the audio signal into M sub-frames, perform the time-frequency transform on each sub-frame, constitute total frequency-domain coefficients of the current frame by M groups of frequency-domain coefficients obtained by transformation, rearrange the total frequency-domain coefficients so that their corresponding coding sub-bands are aligned from low frequencies to high frequencies, wherein, the total frequency-domain coefficients comprise core layer frequency-domain coefficients and extended layer frequency-domain coefficients, the coding sub-bands comprise core layer coding sub-bands and extended layer coding sub-bands, the core layer frequency-domain coefficients constitute several core layer coding sub-bands, and the extended layer frequency-domain coefficients constitute several extended layer coding sub-bands;

the amplitude envelope calculation unit is connected with the frequency-domain coefficient generation unit, and is configured to calculate amplitude envelope values of the core layer coding sub-bands and the extended layer coding sub-bands;

the amplitude envelope quantization and coding unit is connected with the amplitude envelope calculation unit and the transient detection unit, and is configured to quantize and code the amplitude envelope values of the core layer coding sub-bands and the extended layer coding sub-bands, to obtain amplitude envelope quantization indexes and amplitude envelope coded bits of the core layer coding sub-bands and the extended layer coding sub-bands; wherein, if the signal is the steady-state signal, the amplitude envelope values of the core layer coding sub-bands and the extended layer coding sub-bands are jointly quantized, and if the signal is the transient signal, the amplitude envelope values of the core layer coding sub-bands and the extended layer coding sub-bands are separately quantized respectively, and the amplitude envelope quantization indexes of the core layer coding sub-bands and the amplitude envelope quantization indexes of the extended layer coding sub-bands are rearranged respectively;

the core layer bit allocation unit is connected with the amplitude envelope quantization and coding unit, and is configured to perform a bit allocation on the core layer coding sub-bands according to the amplitude envelope quantization indexes of the core layer coding sub-bands, to obtain bit allocation numbers of the core layer coding sub-bands;

the core layer frequency-domain coefficient vector quantization and coding unit is connected with the frequency-domain coefficient generation unit, the amplitude envelope quantization and coding unit and the core layer bit allocation unit, and is configured to: perform normalization, vector quantization and coding on the frequency-domain coefficients of the core layer coding sub-bands by using the bit allocation numbers of the core layer coding sub-bands and quantized amplitude envelope values of the core layer coding sub-bands reconstructed according to the amplitude envelope quantization indexes of the core layer coding sub-bands, to obtain coded bits of the core layer frequency-domain coefficients;

the extended layer coding signal generation unit is connected with the frequency-domain coefficient generation unit and the core layer frequency-domain coefficient vector quantization and coding unit, and is configured to generate core layer residual signals, to obtain extended layer coding signals composed of the core layer residual signals and the extended layer frequency-domain coefficients;

the residual signal amplitude envelope generation unit is connected with the amplitude envelope quantization and coding unit and the core layer bit allocation unit, and is configured to obtain amplitude envelope quantization indexes of the core layer residual signals according to the amplitude envelope quantization indexes of the core layer coding sub-bands and the bit allocation numbers of the corresponding core layer coding sub-bands;

the extended layer bit allocation unit is connected with the residual signal amplitude envelope generation unit and the amplitude envelope quantization and coding unit, and is configured to perform the bit allocation on the coding sub-bands of the extended layer coding signals according to the amplitude envelope quantization indexes of the core layer residual signals and the amplitude envelope quantization indexes of the extended layer coding sub-bands, to obtain the bit allocation numbers of the coding sub-bands of the extended layer coding signals;

the extended layer coding signal vector quantization and coding unit is connected with the amplitude envelope quantization and coding unit, the extended layer bit allocation unit, the residual signal amplitude envelope generation unit, and the extended layer coding signal generation unit, and is configured to: perform normalization, vector quantization and coding on the extended layer coding signals by using the bit allocation numbers of the coding sub-bands of extended layer coding signals and the quantized amplitude envelope values of the coding sub-bands of extended layer coding signals reconstructed according to the amplitude envelope quantization indexes of the coding sub-bands of the extended layer coding signals, to obtain coded bits of the extended layer coding signals;

the bit stream multiplexer is connected with the amplitude envelope quantization and coding unit, the core layer frequency-domain coefficient vector quantization and coding unit, the extended layer coding signal vector quantization and coding unit, and is configured to packet side information bits of the core layer, the amplitude envelope coded bits of the core layer coding sub-bands, the coded bits of the core layer frequency-domain coefficients, side information bits of the extended layer, the amplitude envelope coded bits of the extended layer coding sub-bands, and the coded bits of the extended layer coding signals.

18. The system according to claim 17, wherein, the frequency domain coefficient generation unit is further configured to: when rearranging the frequency-domain coefficients, rearrange the frequency-domain coefficients respectively so that their corresponding coding sub-bands are aligned from low frequencies to high frequencies within the core layer and within the extended layer.

19. The system according to claim 18, wherein, when rearranging respectively within the core layer and within the extended layer, if the frequency-domain coefficients remained in a group is not enough to constitute one sub-band, then a supplement is performed by using frequency-domain coefficients with the same or similar frequencies in the next group of the frequency-domain coefficients.

20. The system according to claim 17, the indexes of the frequency-domain coefficients in the coding sub-bands after rearranging is as follows:

| Serial number of sub-band | Index of starting frequency-domain coefficient (LIndex) | Index of ending frequency-domain coefficient (HIndex) |
|---|---|---|
| 0 | 0 | 15 |
| 1 | 160 | 175 |
| 2 | 320 | 335 |
| 3 | 480 | 495 |
| 4 | 16 | 31 |
| 5 | 176 | 191 |
| 6 | 336 | 351 |
| 7 | 496 | 511 |
| 8 | 32 | 47 |
| 9 | 192 | 207 |
| 10 | 352 | 367 |
| 11 | 512 | 527 |
| 12 | 48 | 63 |
| 13 | 208 | 223 |
| 14 | 368 | 383 |
| 15 | 528 | 543 |
| 16 | 64, 65, 66, 67, 68, 69, 70, 71, 224, 225, 226, 227, 228, 229, 230, 231 | |
| 17 | 384, 385, 386, 387, 388, 389, 390, 391, 544, 545, 546, 547, 548, 549, 550, 551 | |
| 18 | 72 | 87 |
| 19 | 232 | 247 |
| 20 | 392 | 407 |
| 21 | 552 | 567 |
| 22 | 88 | 103 |
| 23 | 248 | 263 |
| 24 | 408 | 423 |
| 25 | 568 | 583 |
| 26 | 104 | 135 |
| 27 | 264 | 295 |
| 28 | 424 | 455 |
| 29 | 584 | 615. |

* * * * *